US009857713B2

(12) United States Patent
Kosaki et al.

(10) Patent No.: US 9,857,713 B2
(45) Date of Patent: Jan. 2, 2018

(54) RESIN PARTICLE AND METHOD OF PRODUCING THE RESIN PARTICLE, AND TONER AND METHOD OF PRODUCING THE TONER

(71) Applicant: CANON KABUSHIKI KAISHA, Tokyo (JP)

(72) Inventors: Yusuke Kosaki, Susono (JP); Tetsuya Kinumatsu, Mishima (JP); Kenji Aoki, Mishima (JP); Noritaka Toyoizumi, Mishima (JP); Shuntaro Watanabe, Hadano (JP); Takaaki Kaya, Suntou-gun (JP); Atsushi Tani, Suntou-gun (JP); Takashige Kasuya, Numazu (JP); Kazumichi Nakahama, Suntou-gun (JP); Shinnosuke Koji, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/973,521

(22) Filed: Dec. 17, 2015

(65) Prior Publication Data

US 2016/0187797 A1 Jun. 30, 2016

(30) Foreign Application Priority Data

Dec. 26, 2014 (JP) ..... 2014-263977
Nov. 30, 2015 (JP) ..... 2015-232615

(51) Int. Cl.
*G03G 9/093* (2006.01)
*G03G 9/08* (2006.01)

(52) U.S. Cl.
CPC ..... *G03G 9/09371* (2013.01); *G03G 9/0804* (2013.01); *G03G 9/09392* (2013.01)

(58) Field of Classification Search
CPC ..... G03G 9/09314
See application file for complete search history.

(56) References Cited

U.S. PATENT DOCUMENTS 5,558,967 A 9/1996 Nagatsuka et al.
7,776,501 B2 8/2010 Tamura et al.
(Continued)

FOREIGN PATENT DOCUMENTS

JP 2008-89908 A 4/2008
JP 2010-132851 A 6/2010
(Continued)

OTHER PUBLICATIONS

Abstract of WIPO WO/2013/081172 Jun. 6, 2013.*
Toyoizumi, et al., U.S. Appl. No. 14/973,531, filed Dec. 17, 2015.

*Primary Examiner* — Hoa V Le
(74) *Attorney, Agent, or Firm* — Fitzpatrick Cella Harper and Scinto

(57) ABSTRACT

Provided is a toner, comprising a toner particle having a core-shell structure composed of a core particle and a shell phase on a surface of the core particle, the core particle containing a resin X and a colorant, the shell phase being derived from a resin fine particle containing a resin Y, in which a relationship among a SP value of the resin X, a SP value of the resin Y, and a SP value of an organic solvent falls within a specific range, and a relationship between a number-average particle diameter of the resin fine particle when the resin fine particle is dispersed in water and a number-average particle diameter of the resin fine particle when the resin fine particle is dispersed in the organic solvent falls within a specific range.

7 Claims, 2 Drawing Sheets

(56) References Cited

U.S. PATENT DOCUMENTS

| | | | | |
|---|---|---|---|---|
| 7,794,908 | B2 | 9/2010 | Kaya et al. | |
| 8,603,712 | B2 | 12/2013 | Aoki et al. | |
| 8,741,519 | B2 | 6/2014 | Watanabe et al. | |
| 8,785,101 | B2 | 7/2014 | Kaya et al. | |
| 8,846,284 | B2 | 9/2014 | Kinumatsu et al. | |
| 9,056,955 | B2 | 6/2015 | Mizumori et al. | |
| 9,176,410 | B2 | 11/2015 | Tani et al. | |
| 2010/0273102 | A1 | 10/2010 | Tamura et al. | |
| 2012/0100478 | A1* | 4/2012 | Sukeno | G03G 9/0806 430/109.4 |
| 2013/0122414 | A1* | 5/2013 | Aoki | G03G 9/08728 430/109.3 |
| 2013/0130165 | A1* | 5/2013 | Kinumatsu | G03G 9/0802 430/109.1 |
| 2013/0130170 | A1* | 5/2013 | Watanabe | G03G 9/09328 430/109.31 |
| 2013/0323637 | A1* | 12/2013 | Watanabe | G03G 9/0802 430/109.4 |
| 2014/0134526 | A1* | 5/2014 | Matsumoto | G03G 9/08755 430/105 |
| 2014/0220486 | A1 | 8/2014 | Kaya et al. | |
| 2014/0349232 | A1 | 11/2014 | Kinumatsu et al. | |
| 2014/0356777 | A1* | 12/2014 | Tani | G03G 9/09321 430/108.3 |
| 2015/0044602 | A1* | 2/2015 | Kitagawa | G03G 9/0806 430/105 |
| 2015/0072276 | A1* | 3/2015 | Shinya | G03G 9/08726 430/105 |
| 2015/0177632 | A1* | 6/2015 | Imae | G03G 9/09328 430/109.3 |
| 2015/0274879 | A1 | 10/2015 | Watanabe et al. | |

FOREIGN PATENT DOCUMENTS

| | | | |
|---|---|---|---|
| JP | 2010-217269 | A | 9/2010 |
| JP | 2013-11884 | A | 1/2013 |
| JP | 2013-49855 | A | 3/2013 |
| JP | 2013-137535 | A | 7/2013 |

* cited by examiner

RESIN PARTICLE AND METHOD OF PRODUCING THE RESIN PARTICLE, AND TONER AND METHOD OF PRODUCING THE TONER

BACKGROUND OF THE INVENTION

Field of the Invention

The present invention relates to a resin particle and a method of producing the resin particle, and a toner to be used in a recording method involving utilizing an electrophotographic method, an electrostatic recording method, and a toner jet type recording method, and a method of producing the toner.

Description of the Related Art

Resin particles have been used in a wide variety of fields including a paint, an ink, and a toner. In each of the fields, the control of the particle diameters and particle size distribution of the resin particles is important, and in particular, resin particles that achieve both a small particle diameter and the sharpness of their particle size distribution have been desired.

Particularly in the toner field out of those fields, an improvement in quality of an image formed of the toner has been required. The improvement in quality of the image formed of the toner requires the suppression of a variation in charging performance between the particles of the toner. To that end, the uniformization of the particle diameters of the toner, i.e., the sharpening of its particle size distribution is effective, and a "dissolution suspension method" has been proposed as an approach to the sharpening. The dissolution suspension method is a production method involving: dispersing a resin solution, which is obtained by dissolving a resin in an organic solvent in advance, in a dispersion medium in the presence of a dispersant to form a droplet of the resin solution; and then removing the organic solvent to provide a resin particle. A polymer dispersant or a solid fine particle can be used as the dispersant in the dissolution suspension method, and examples of the solid fine particle include an inorganic fine particle and a resin fine particle. A general dispersion medium in the dissolution suspension method is, for example, water. In recent years, however, a production method involving using carbon dioxide in a liquid or supercritical state as a dispersion medium has been developed, and has an advantage in that in the production of the toner particles, energy savings can be achieved by the elimination of a washing step and a drying step. However, the carbon dioxide in a liquid or supercritical state has higher solubility in a resin than in water. Accordingly, when the resin fine particle is used as the dispersant, the stability of the resin fine particle against carbon dioxide is required for the resin fine particle to function as the dispersant to suppress the agglomeration of the droplets.

In addition, in recent years, an electrophotographic apparatus has started to be used under various environments for a long time period in association with the diversification of its use environments. In particular, when the electrophotographic apparatus is used under a high-temperature and high-humidity environment for a long time period, there has been occurring a problem in that a wax exudes to the surface of a toner to cause the agglomeration of the toner particles or to cause member contamination in the electrophotographic apparatus. To cope with the problem, a toner having a core-shell structure in which the surface of a resin serving as a core is covered with a shell resin having a Tg higher than that of the core resin has been proposed. When the toner has the structure, the wax hardly exudes to the surface of the toner. Accordingly, the above-mentioned problems, such as the agglomeration of the toner particles and the member contamination, can be suppressed, and hence a high-quality image can be continuously provided.

According to the dissolution suspension method described in the foregoing, the resin fine particle used as the dispersant adheres to the surface of the droplet of the resin solution, and remains on the surface of the resin particle even after the removal of the organic solvent. Accordingly, a toner having a core-shell structure in which a shell based on the resin fine particle has been formed can be obtained.

In Japanese Patent Application Laid-Open No. 2010-132851, there is proposed a resin particle having a core-shell structure in which a shell based on a resin fine particle that hardly swells in carbon dioxide has been formed, the resin particle being obtained by a dissolution suspension method involving using carbon dioxide as a dispersion medium and using the resin fine particle as a dispersant for the purpose of suppressing the agglomeration of droplets. In the literature, a fine particle based on a crystalline polyester resin, a polybehenyl acrylate or a copolymer resin thereof, or a crosslinkable vinyl resin has been used as the resin fine particle.

In addition, in Japanese Patent Application Laid-Open No. 2013-137535, there is proposed a toner using a resin fine particle containing a resin having a graft type structure using, as constituent components, a moiety having an organic polysiloxane structure and a moiety having an aliphatic polyester structure. In the literature, a toner having a satisfactory particle size distribution is obtained because the toner is produced through the use of the resin fine particle having affinities for both carbon dioxide and a resin solution by a dissolution suspension method involving using carbon dioxide as a dispersion medium. Further, it has been found that the resultant toner satisfies adhesiveness between the resin fine particles, and adhesiveness between the resin fine particle and a core particle, and does not cause any problem resulting from the exudation of a wax.

SUMMARY OF THE INVENTION

However, the inventors of the present invention have produced a toner based on Japanese Patent Application Laid-Open No. 2010-132851 and have investigated the toner, and as a result, have found that a toner having a sharp particle size distribution is not necessarily obtained when the fine particle based on the crystalline polyester resin, or the polybehenyl acrylate or the copolymer resin thereof is used. A possible cause for the foregoing is that the polyester resin, or the polybehenyl acrylate or the copolymer resin thereof has low stability against an organic solvent, and hence the resin fine particle functions as a dispersant to a low degree and cannot sufficiently suppress the coalescence of the droplets.

The inventors have found that on the other hand, when the fine particle based on the crosslinkable vinyl resin is used as the dispersant, the resin has stability against an organic solvent, but the exudation of the wax from a toner that has been left to stand under a high-temperature and high-humidity environment for a long time period may occur, and hence preventing effects on the agglomeration of the toner particles and member contamination are insufficient. As a result of their investigation on a cause for the foregoing, the inventors have found that the foregoing is caused by the following new problem. The resin fine particle used in the literature has a large extent of crosslinking and is excessively suppressed in swelling in the organic solvent, and hence adhesiveness between the resin fine particles or the adhesiveness of the resin fine particle with a core becomes insufficient.

In addition, the inventors have investigated the toner of Japanese Patent Application Laid-Open No. 2013-137535, and have considered that a toner having an additionally sharp particle size distribution is obtained by forming a droplet in a temperature region where the viscosity of the resin solution reduces. In view of the foregoing, the inventors have produced a toner particle at an additionally high temperature. Contrary to their expectation, however, the inventors have been unable to obtain a toner having a satisfactory particle size distribution. A possible cause for the foregoing is as described below. The stability of the resin fine particle against an organic solvent reduces in the additionally high temperature region, and hence the function of the resin fine particle as a dispersant also reduces. Accordingly, the coalescence of the droplets cannot be sufficiently suppressed.

As is understood from the foregoing, there still remain problems to be solved for achieving both an improvement in quality of an image formed of a toner and high durability of the toner.

The present invention is directed to providing a resin particle and a method of producing the resin particle, and a toner and a method of producing the toner that have solved the conventional problems.

That is, the present invention is directed to providing a resin particle having a sharp particle size distribution and a method of producing the resin particle, and a toner having a sharp particle size distribution and excellent in durability, and a method of producing the toner.

According to one aspect of the present invention, there is provided a toner comprising a toner particle, the toner particle having a core-shell structure composed of a core particle and a shell phase on a surface of the core particle, wherein:

the core particle comprises a resin X and a colorant;

the shell phase is derived from a resin fine particle comprising a resin Y;

the resin fine particle swells in an organic solvent;

the resin X, the resin Y, and the organic solvent satisfy the following formulae (1) and (2); and the resin fine particle satisfies the following formulae (3) and (4):

$$|SP_X - SP_Y| \leq 4.0 \quad (1)$$

$$|SP_{SOL} - (SP_X + SP_Y)/2| \leq 4.0 \quad (2)$$

in the formulae (1) and (2), $SP_X$ represents a SP value $((J/cm^3)^{1/2})$ of the resin X, $SP_Y$ represents a SP value $((J/cm^3)^{1/2})$ of the resin Y, and $SP_{SOL}$ represents a SP value $((J/cm^3)^{1/2})$ of the organic solvent;

$$50 \leq A \leq 200 \quad (3)$$

$$1.30 \leq (4\pi(B/2)^3/3)/(4\pi(A/2)^3/3) \leq 3.00 \quad (4)$$

in the formulae (3) and (4),

"A" represents a number-average particle diameter (nm) of the resin fine particle when the resin fine particle is dispersed in water, and "B" represents a number-average particle diameter (nm) of the resin fine particle when the resin fine particle is dispersed in the organic solvent.

According to another aspect of the present invention, there is provided a method of producing a toner having a toner particle, including:

(a) mixing a resin X, a colorant, and an organic solvent to prepare a resin solution;

(b) mixing the resin solution, a resin fine particle comprising a resin Y, and a dispersion medium to form a droplet of the resin solution; and (c) removing the organic solvent in the droplet to form a shell phase derived from the resin fine particle on a surface of a core particle comprising the resin X to provide the toner particle, the resin X, the resin Y, and the organic solvent satisfying the following formulae (5) and (6), the resin fine particle satisfying the following formulae (3) and (4):

$$0.1 \leq |(SP_{SOL} + SP_X)/2 - SP_Y| \leq 4.0 \quad (5)$$

$$|SP_{SOL} - SP_Y| \leq 4.0 \quad (6)$$

in the formulae (5) and (6), $SP_X$ represents a SP value $((J/cm^3)^{1/2})$ of the resin X, $SP_Y$ represents a SP value $((J/cm^3)^{1/2})$ of the resin Y, and $SP_{SOL}$ represents a SP value $((J/cm^3)^{1/2})$ of the organic solvent;

$$50 \leq A \leq 200 \quad (3)$$

$$1.30 \leq (4\pi(B/2)^3/3)/(4\pi(A/2)^3/3) \leq 3.00 \quad (4)$$

in the formulae (3) and (4),

"A" represents a number-average particle diameter (nm) of the resin fine particle when the resin fine particle is dispersed in water, and "B" represents a number-average particle diameter (nm) of the resin fine particle when the resin fine particle is dispersed in the organic solvent.

According to further aspect of the present invention, there is provided a resin particle having a core-shell structure composed of a core particle and a shell phase on a surface of the core particle, wherein:

the core particle comprises a resin X;

the shell phase is derived from a resin fine particle comprising a resin Y;

the resin fine particle swells in an organic solvent;

the resin X, the resin Y, and the organic solvent satisfy the following formulae (1) and (2); and the resin fine particle satisfies the following formulae (3) and (4):

$$|SP_X - SP_Y| \leq 4.0 \quad (1)$$

$$|SP_{SOL} - (SP_X + SP_Y)/2| \leq 4.0 \quad (2)$$

in the formulae (1) and (2), $SP_X$ represents a SP value $((J/cm^3)^{1/2})$ of the resin X, $SP_Y$ represents a SP value $((J/cm^3)^{1/2})$ of the resin Y, and $SP_{SOL}$ represents a SP value $((J/cm^3)^{1/2})$ of the organic solvent;

$$50 \leq A \leq 200 \quad (3)$$

$$1.30 \leq (4\pi(B/2)^3/3)/(4\pi(A/2)^3/3) \leq 3.00 \quad (4)$$

in the formulae (3) and (4),

"A" represents a number-average particle diameter (nm) of the resin fine particle when the resin fine particle is dispersed in water, and "B" represents a number-average particle diameter (nm) of the resin fine particle when the resin fine particle is dispersed in the organic solvent.

According to further aspect of the present invention, there is provided a method of producing a resin particle, including:

(a) mixing a resin X and an organic solvent to prepare a resin solution;

(b) mixing the resin solution, a resin fine particle comprising a resin Y, and a dispersion medium to form a droplet of the resin solution; and (c) removing the organic solvent in the droplet to form a shell phase derived from the resin fine particle on a surface of a core particle comprising the resin X, the resin X, the resin Y, and the organic solvent satisfying the following formulae (5) and (6), the resin fine particle satisfying the following formulae (3) and (4):

$$0.1 \leq |(SP_{SOL}+SP_X)/2-SP_Y| \leq 4.0 \quad (5)$$

$$|SP_{SOL}-SP_Y| \leq 4.0 \quad (6)$$

in the formulae (5) and (6), $SP_X$ represents a SP value ($(J/cm^3)^{1/2}$) of the resin X, $SP_Y$ represents a SP value ($(J/cm^3)^{1/2}$) of the resin Y, and $SP_{SOL}$ represents a SP value ($(J/cm^3)^{1/2}$) of the organic solvent;

$$50 \leq A \leq 200 \quad (3)$$

$$1.30 \leq (4\pi(B/2)^3/3)/(4\pi(A/2)^3/3) \leq 3.00 \quad (4)$$

in the formulae (3) and (4),

"A" represents a number-average particle diameter (nm) of the resin fine particle when the resin fine particle is dispersed in water, and "B" represents a number-average particle diameter (nm) of the resin fine particle when the resin fine particle is dispersed in the organic solvent.

According to the aspects of the present invention, the resin particle having a sharp particle size distribution and the method of producing the resin particle, and the toner having a sharp particle size distribution and excellent in durability, and the method of producing the toner can be provided.

Further features of the present invention will become apparent from the following description of exemplary embodiments with reference to the attached drawings.

DESCRIPTION OF THE EMBODIMENTS

Figure 1:
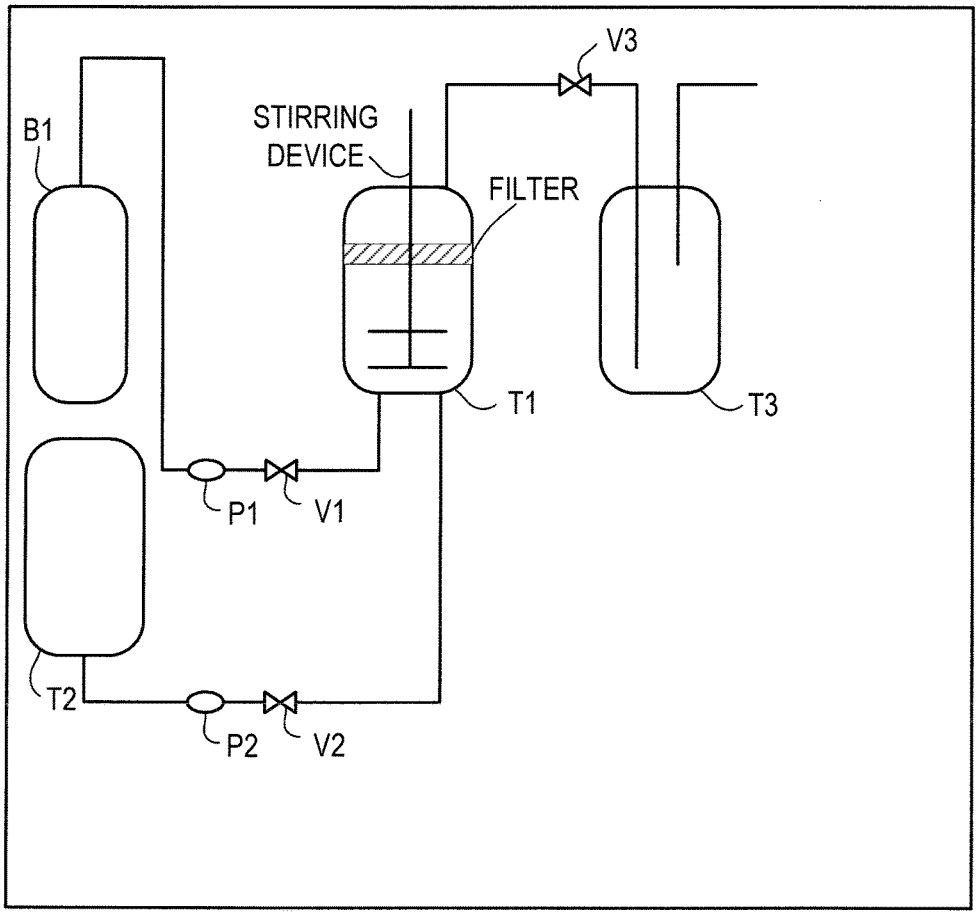
FIG. 1 is a schematic view for illustrating an example of an apparatus for producing a resin particle and a toner of the present invention.

The present invention is hereinafter more specifically described by way of embodiments.

A resin particle of the present invention is a resin particle having a core-shell structure in which a shell phase derived from a resin fine particle containing a resin Y is formed on the surface of a core particle containing a resin X. The resin fine particle swells in an organic solvent. In addition, the shell phase is preferably formed through the step of bringing the core particle and the resin fine particle into contact with each other in the presence of the organic solvent.

In addition, a method of producing a resin particle of the present invention has a feature of including the following steps:

(a) mixing a resin X and an organic solvent to prepare a resin solution;

(b) mixing the resin solution, a resin fine particle containing a resin Y, and a dispersion medium to form a droplet of the resin solution; and (c) removing the organic solvent in the droplet to form a shell phase derived from the resin fine particle on a surface of a core particle containing the resin X.

In addition, a toner of the present invention is a toner containing a toner particle having a core-shell structure composed of a core particle and a shell phase on a surface of the core particle, the core particle contains the resin X and a colorant, and a shell phase is derived from a resin fine particle containing the resin Y.

The resin fine particle swells in an organic solvent. In addition, the shell phase is preferably formed through the step of bringing the core particle and the resin fine particle into contact with each other in the presence of the organic solvent.

In addition, a method of producing a toner including a toner particle of the present invention has a feature of including the following steps:

(a) mixing a resin X, a colorant, and an organic solvent to prepare a resin solution;

(b) mixing the resin solution, a resin fine particle containing a resin Y, and a dispersion medium to form a droplet of the resin solution; and (c) removing the organic solvent in the droplet to form a shell phase derived from the resin fine particle on a surface of a core particle containing the resin X to provide the toner particle.

In the present invention, the shell phase is preferably formed through the step of bringing the core particle and the resin fine particle into contact with each other in the presence of the organic solvent. The formation process for the shell phase means that the organic solvent mediates the formation of the shell phase in some way, and examples include the following modes:

(i) a shell phase formed by adding or spraying the organic solvent under a state in which the resin fine particle adheres to the surface of the core particle;

(ii) a shell phase formed by dispersing the core particle and the resin fine particle in a dispersion medium containing the organic solvent, and then agglomerating and sticking the resin fine particle to the surface of the core particle;

(iii) a shell phase formed by dispersing a resin solution, which is obtained by dissolving a resin constituting the core particle in the organic solvent, and the resin fine particle in the dispersion medium, and then removing the organic solvent under a state in which the resin fine particle adheres to the surface of a droplet based on the resin solution; and (iv) a shell phase formed by dispersing a precursor solution, which is obtained by dissolving a precursor of the resin constituting the core particle in the organic solvent, and the resin fine particle in the dispersion medium, and then subjecting the precursor to a reaction to form a resin under a state in which the resin fine particle adheres to the surface of a droplet based on the precursor solution and removing the organic solvent.

In order to form the shell phase through such formation process as described above, the resin fine particle needs to swell in the organic solvent.

In the resin particle and toner of the present invention, the $SP_X$, the $SP_Y$, and the $SP_{SOL}$ satisfy the following formulae (1) and (2).

$$|SP_X-SP_Y| \leq 4.0 \quad (1)$$

$$|SP_{SOL}-(SP_X+SP_Y)/2| \leq 4.0 \quad (2)$$

A SP value is also called a solubility parameter, and is a numerical value used as an indicator of solubility or affinity representing the extent to which a substance dissolves in another substance. When the SP values of the substances are close to each other, the substances have high solubility or affinity for each other, and when the SP values of the substances are distant from each other, the substances have low solubility or affinity for each other. The SP value can be calculated with solubility parameter-calculating software (Hansen Solubility Parameters in Practice).

The resin fine particle forms shell phases on the surfaces of the resin particle and the toner particle, and particularly in the case of the toner, serves to suppress the exudation of a wax to the surface of the toner under a high-temperature and high-humidity environment.

Adhesive forces between the resin fine particles, and between the resin fine particle and the core particle can be improved by designing the relationships among the $SP_X$, the $SP_Y$, and the $SP_{SOL}$ so that the relationships may fall within the ranges represented by the formulae (1) and (2). As a result, a shell phase excellent in adhesiveness with the core particle can be formed. Thus, particularly in the case of the toner, the exudation of the wax to the surface of the toner when the toner is used under a high-temperature and high-humidity environment for a long time period can be suppressed, and hence a toner excellent in durability can be obtained.

When a value for $|SP_Y-SP_Y|$ exceeds 4.0 $(J/cm^3)^{1/2}$, an affinity between the resin fine particle and the core particle becomes insufficient, and hence the adhesion force of the resin fine particle with the core particle reduces. As a result, adhesiveness between the shell phase to be formed and the core particle reduces, and particularly in the case of the toner, when the toner is used under a high-temperature and high-humidity environment for a long time period, the exudation of the wax is liable to occur, which causes a reduction in durability of the toner.

In addition, when a value for $|SP_{SOL}-(SP_X+SP_Y)/2|$ exceeds 4.0 $(J/cm^3)^{1/2}$, an affinity between the organic solvent, and each of the resin fine particle and the core particle reduces, and hence the adhesive forces between the resin fine particles, and between the resin fine particle and the core particle reduce. As a result, the adhesiveness between the shell phase to be formed and the core particle reduces, and particularly in the case of the toner, when the toner is used under a high-temperature and high-humidity environment for a long time period, the exudation of the wax is liable to occur, which causes the reduction in durability of the toner.

In view of the foregoing, the value for $|SP_X-SP_Y|$ needs to be 4.0 or less, and is more preferably 3.0 or less. In addition, the value for $|SP_{SOL}-(SP_X+SP_Y)/2|$ needs to be 4.0 or less, and is more preferably 3.0 or less.

When the production of the resin particle and toner of the present invention is performed through the formation process for the shell phase described in the item (iii) or (iv) typified by a dissolution suspension method, the $SP_X$, the $SP_Y$, and the $SP_{SOL}$ need to satisfy the following formulae (5) and (6).

$$0.1 \leq |(SP_{SOL}+SP_Y)/2-SP_Y| \leq 4.0 \quad (5)$$

$$|SP_{SOL}-SP_Y| \leq 4.0 \quad (6)$$

When the shell phase is formed by the dissolution suspension method, the resin fine particle adsorbs to the surface of a droplet based on the resin solution in the step of forming the droplet to serve as a dispersant for improving the dispersibility of the droplet.

The resin fine particle that has adsorbed to the surface of the droplet can be prevented from being liberated or from being embedded in the droplet by designing the relationship among the $SP_X$, the $SP_Y$, and the $SP_{SOL}$ so that the relationship may fall within the range represented by the formula (5). In addition, a sufficient affinity is obtained between the resin fine particle and the organic solvent by designing the relationship among the SP values so that the relationship may fall within the range represented by the formula (6). As a result, the surface of the resin fine particle softens, adhesiveness between the resin fine particles improves, and hence a high shielding effect on the droplet is obtained. Accordingly, the dispersion stability improves. Therefore, the particle size distributions of the resin particles and the toner can be sharpened by satisfying the relationships represented by the formulae (5) and (6).

When a value for $|(SP_{SOL}+SP_X)/2-SP_Y|$ exceeds 4.0 $(J/cm^3)^{1/2}$, an affinity between the resin fine particle and the droplet reduces. As a result, the resin fine particle is liable to be liberated from the surface of the droplet, and hence the particle size distributions of the resin particles and the toner broaden.

On the other hand, when the value for $|(SP_{SOL}+SP_X)/2-SP_Y|$ falls below 0.1 $(J/cm^3)^{1/2}$, the resin fine particle is liable to be taken in the droplet and hence the coalescence of the droplets cannot be suppressed. Accordingly, the particle size distributions of the resin particles and the toner broaden. The value for $|(SP_{SOL}+SP_X)/2-SP_Y|$ is more preferably 0.5 or more and 3.0 or less.

In addition, when a value for $|SP_{SOL}-SP_Y|$ exceeds 4.0 $(J/cm^3)^{1/2}$, the softening of the surface of the resin fine particle is insufficient, and hence the adhesiveness between the resin fine particles is insufficient. Accordingly, the shielding effect of the resin fine particle on the droplet reduces at the time of collision between the droplets, and hence the dispersion stability of the droplet reduces. As a result, the particle size distribution of the resin particles broadens. The value for $|SP_{SOL}-SP_Y|$ is more preferably 3.0 or less.

In the present invention, a number-average particle diameter A of the resin fine particles when the resin fine particles are dispersed in water satisfies the following formula (3).

$$50 \leq A \leq 200 \quad (3)$$

In this case, water is a medium having extremely low solubility for a resin, and the number-average particle diameter A of the resin fine particles when the resin fine particles are dispersed in water represents a particle diameter in a state in which the resin fine particles do not swell, i.e., the original particle diameter of the resin fine particles.

When the production of the resin particle and toner of the present invention is performed by the dissolution suspension method, in order to improve the dispersibility of the droplet, a somewhat large particle needs to be used as a dispersant for preventing the coalescence of the droplets. In addition, the resin fine particle needs to be free from being easily liberated from the surface of the droplet until the step of removing the organic solvent is terminated.

When the number-average particle diameter A of the resin fine particles is less than 50 nm, an attraction acting between the resin fine particle and the droplet increases, and hence the adsorbing action strengthens. Meanwhile, steric repulsion between the droplets having adsorbed thereto the resin fine particles reduces, and hence a dispersion-stabilizing action weakens. Therefore, the coalescence of the droplets occurs, and hence the particle size distributions of the resin particles and the toner broaden.

When the number-average particle diameter A of the resin fine particles is more than 200 nm, the steric repulsion between the droplets having adsorbed thereto the resin fine particles increases, and hence the dispersion-stabilizing action strengthens. Meanwhile, the attraction acting between the resin fine particle and the droplet reduces, and hence the adsorbing action weakens. Therefore, it becomes difficult to maintain a state in which the resin fine particle adsorbs to the droplet. Accordingly, the coverages of the droplets with the resin fine particles reduce, the coalescence of the droplets cannot be prevented, and hence the particle size distributions of the resin particles and the toner broaden. Therefore, setting the average particle diameter of the resin fine particles to a proper range is important for sharpening the particle size distributions of the resin particles and the toner.

In addition, in order to provide a moderate thickness to a shell phase particularly in a toner application to suppress the exudation of the wax to the surface of the toner under a high-temperature and high-humidity environment, a somewhat large resin fine particle needs to be used. However, when the particle diameter of the resin fine particle is excessively large, the shell phase becomes excessively thick, which is responsible for the inhibition of the fixability of the toner. Therefore, in order to achieve both the durability and fixability of the toner, it is important that the number-average particle diameter A of the resin fine particles be set to 200 nm or less.

The number-average particle diameter A of the resin fine particles when the resin fine particles are dispersed in water more preferably falls within the range of from 70 nm or more to 150 nm or less.

The inventors of the present invention have paid attention to the following specification as an indicator indicating that the resin fine particle swells in the organic solvent. The inventors have paid attention to a relationship between the number-average particle diameter (A) of the resin fine particles when the resin fine particles are dispersed in water and the number-average particle diameter (B) of the resin fine particles when the resin fine particles are dispersed in the organic solvent, i.e., the degree of swelling of the resin fine particles. The degree of swelling in the present invention is a value obtained by dividing the volume of the resin fine particles when the resin fine particles are dispersed in the organic solvent having higher solubility for a resin than that of water by the volume of the resin fine particles when the resin fine particles are dispersed in water serving as a solvent having extremely low solubility for the resin, i.e., a volume ratio, and is represented by the following formula (11).

$$\text{Degree of swelling}=(4\pi(B/2)^3/3)/(4\pi(A/2)^3/3) \quad (11)$$

The inventors of the present invention have made detailed investigations on the influences of the composition and molecular structure of a resin constituting the resin fine particles on the degree of swelling of the resin fine particles. As a result, the inventors have found that controlling the degree of swelling to a specific range additionally improves the adhesiveness between the shell phase to be formed by the resin fine particle and the core particle, and in the production of the resin particles and the toner by the dissolution suspension method, can additionally sharpen their particle size distributions. Thus, the inventors have reached the present invention.

When the resin fine particle comes into contact with the organic solvent having a high affinity for a resin, the resin fine particle swells and hence its surface softens. When the surface of the resin fine particle softens, entanglement at a molecular level occurs between the resin fine particles or between the core particle and the resin fine particle, and hence the adhesiveness improves. However, when the surface of the resin fine particle excessively softens, the agglomeration of the resin particles or the toner particles through intermediation of the resin fine particle occurs in the formation process for the shell phase involving bringing the core particle and the resin fine particle into contact with each other in the presence of the organic solvent. In view of the foregoing, the inventors have found that proper control of the degree of swelling of the resin fine particles is important for achieving: the suppression of the agglomeration of the resin particles or the toner particles; and improvements in adhesiveness between the resin fine particles, and adhesiveness between the resin fine particle and the core particle.

In addition, when the resin fine particle is used in the dissolution suspension method, the resin fine particle functions as a dispersant and hence can suppress the agglomeration of the droplets. When the resin fine particle comes into contact with the organic solvent and hence its surface softens, entanglement at a molecular level occurs between the resin fine particles, and hence the dispersion stability of the droplet can be improved. However, excessive swelling of the resin fine particle tends to reduce the stability of the resin fine particle against the organic solvent to cause the agglomeration of the droplets. Accordingly, the inventors have found that making the degree of swelling proper is important for sharpening the particle size distribution of the resin particles.

The degree of swelling of the resin fine particles depends mainly on the composition of a monomer serving as a constituent component for the resin Y, the crosslink density, and the kind of the organic solvent to be used. The degree of swelling can be controlled by the temperature at which the core particle and the resin fine particle are brought into contact with each other in the presence of the organic solvent as well as the foregoing. When the composition of the monomer is changed, an influence of the change on the function of the resin fine particle as a dispersant needs to be taken into consideration. In addition, when the degree of swelling is controlled by the kind of the organic solvent to be used or the temperature, restrictions may be imposed on conditions at the time of the formation of the droplet. Therefore, the degree of swelling is preferably controlled by the crosslink density. The crosslink density can be controlled by the degree of unsaturation and molecular weight of the monomer to be used, and the ratio of the number of parts of the monomer to be used to the total number of parts of monomers. The term "degree of unsaturation" as used herein refers to the average number of polymerizable unsaturated groups in one molecule.

In the present invention, the relationship between the number-average particle diameter A of the resin fine particles when the resin fine particles are dispersed in water and the number-average particle diameter B of the resin fine particles when the resin fine particles are dispersed in the organic solvent, i.e., the degree of swelling of the resin fine particles satisfies the following formula (4).

$$1.30 \leq (4\pi(B/2)^3/3)/(4\pi(A/2)^3/3) \leq 3.00 \quad (4)$$

Controlling the degree of swelling to the range represented by the formula (4) can achieve both the suppression of the agglomeration of the resin particles or the toner particles, and the improvements in adhesiveness between the resin fine particles, and adhesiveness between the core particle and the resin fine particle, and hence can achieve both an improvement in quality of an image and an improvement in durability of the toner.

In the resin particle and toner of the present invention, when the degree of swelling of the resin fine particles to be used is less than 1.30, the softening of the surfaces of the resin fine particles is insufficient, and hence the adhesiveness between the resin fine particles, and the adhesiveness between the resin fine particle and the core particle reduce. As a result, the liberation of the shell phase to be formed is liable to occur. Accordingly, particularly in the case of the toner, when the toner is used under a high-temperature and high-humidity environment for a long time period, the exudation of the wax occurs, and hence the agglomeration of the toner particles and member contamination occur.

When the degree of swelling is more than 3.00, the agglomeration of the resin particles or the toner particles through intermediation of the resin fine particle is liable to occur in the formation process for the shell phase involving bringing the core particle and the resin fine particle into contact with each other in the presence of the organic solvent.

In the production of the resin particles and the toner by the dissolution suspension method, when the degree of swelling of the resin fine particles is less than 1.30, the softening of the surfaces of the resin fine particles is insufficient, and hence the adhesiveness between the resin fine particles becomes insufficient. Accordingly, the dispersion stability of the droplet reduces. As a result, the particle size distribution of the resin particles broadens.

On the other hand, when the degree of swelling is more than 3.00, the stability of the resin fine particle against the organic solvent cannot be held owing to the excessive swelling of the resin fine particle, and hence its function as a dispersant reduces. As a result, the coalescence of the droplets cannot be sufficiently suppressed and hence the particle size distribution of the resin particles broadens.

In view of the foregoing, the degree of swelling of the resin fine particles needs to be 1.30 or more and 3.00 or less, and is more preferably 1.60 or more and 2.50 or less.

In the resin particle of the present invention, the resin Y is preferably a polymer of a monomer composition containing a monomer having an average number of polymerizable unsaturated groups in one molecule of 2.0 or more. The average number of polymerizable unsaturated groups represents the degree of unsaturation of the monomer having a polymerizable unsaturated group. Setting the average number of polymerizable unsaturated groups within the range facilitates the control of the degree of swelling of the resin fine particles to the range represented by the formula (4).

When the average number of polymerizable unsaturated groups is 2.0 or more, the crosslink density based on the monomer having a polymerizable unsaturated group additionally increases, and hence it becomes easy to control the degree of swelling. Accordingly, the resin fine particle is excellent in stability against the organic solvent, and hence the particle size distribution of the resin particles can easily sharpen.

In the toner of the present invention, the resin Y is preferably a polymer having a crosslinked structure, and the introduction of the crosslinked structure facilitates the control of the degree of swelling of the resin fine particles to the range represented by the formula (4).

In addition, in the toner of the present invention, it is preferred that the resin Y contain a polyester and the resin X contain a polyester as a main component. With such construction, the adhesiveness between the resin fine particle and the core particle can be improved, and hence a structure having the following characteristic can be formed: even when the toner is used under a high-temperature and high-humidity environment for a long time period, the wax hardly exudes to the outside of the toner.

Examples of the organic solvent in this case include the following: ketone-based organic solvents, such as acetone, methyl ethyl ketone, methyl isobutyl ketone, and di-n-butyl ketone; ester-based organic solvents, such as ethyl acetate, butyl acetate, and methoxybutyl acetate; ether-based organic solvents, such as tetrahydrofuran, diethyl ether, dioxane, ethyl cellosolve, and butyl cellosolve; amide-based organic solvents, such as dimethylformamide and dimethylacetamide; aromatic hydrocarbon-based organic solvents, such as toluene, xylene, and ethylbenzene; and an aromatic alcohol-based organic solvent, such as 2-phenylethanol.

Particularly in the case of the toner, the SP value ($SP_{SOL}$ $(J/cm^3)^{1/2}$) of the organic solvent is preferably 18.0 or more and 23.0 or less.

When the $SP_{SOL}$ is 23.0 $(J/cm^3)^{1/2}$ or less, a difference in SP value between the organic solvent and the polyester additionally reduces, and hence the affinity of the organic solvent for the polyester in the resin fine particle or in the binder resin additionally improves. Thus, the adhesiveness between the resin fine particles, and the adhesiveness between the core particle and the resin fine particle additionally improve.

When the $SP_{SOL}$ is 18.0 $(J/cm^3)^{1/2}$ or more, the difference in SP value between the organic solvent and the polyester does not become excessively close to 0, and hence the resin fine particle is hardly taken in the core particle. Thus, the exudation of the wax to the surface of the toner when the toner is left to stand under a high-temperature and high-humidity environment for a long time period is additionally suppressed.

Of those organic solvents described above, ethyl acetate (18.2), methyl ethyl ketone (19.1), tetrahydrofuran (19.5), and acetone (19.9) are particularly preferred.

Now, the resin Y to be incorporated into the resin fine particle to be used in the toner of the present invention is described in more detail.

In the toner of the present invention, the SP value ($SP_Y$) of the resin Y is preferably 24.0 $(J/cm^3)^{1/2}$ or less, particularly preferably 15.0 $(J/cm^3)^{1/2}$ or more and 23.0 $(J/cm^3)^{1/2}$ or less. When the SP value of the resin Y is set to fall within the range, the SP value of the resin Y becomes sufficiently close to the SP value ($SP_{SOL}$) of the organic solvent, and hence the resin Y can easily swell in the organic solvent.

The resin Y is preferably a polymer of a monomer composition containing a polyester having a polymerizable unsaturated group.

The introduction of the crosslinked structure described above may be performed by using the polyester having a polymerizable unsaturated group, may be performed by using a monomer having two or more polymerizable unsaturated groups (hereinafter sometimes referred to as "polyfunctional monomer"), or may be performed by using the polyester and the monomer in combination.

The polyester having a polymerizable unsaturated group preferably has an average number of polymerizable unsaturated groups in one molecule of the polyester of 1.0 or more and 3.0 or less. Setting the average number of polymerizable unsaturated groups within the range enables appropriate control of the degree of swelling of the resin fine particles.

When the average number of polymerizable unsaturated groups is 1.0 or more, the crosslinked structure based on the polyester having a polymerizable unsaturated group additionally progresses, and hence the degree of swelling can be easily controlled. Accordingly, the stability against the organic solvent improves, and hence the particle size distribution of the toner to be obtained can additionally sharpen with ease.

Meanwhile, when the average number of polymerizable unsaturated groups is 3.0 or less, the crosslink density based on the polyester having a polymerizable unsaturated group is not excessively large, and hence the degree of swelling can be easily controlled. Accordingly, the rise of the difficulty with which the resin fine particle swells in the organic solvent is suppressed, and hence the adhesiveness between the resin fine particles, and the adhesiveness between the resin fine particle and the core particle improve.

The average number of polymerizable unsaturated groups in one molecule of the polyester having a polymerizable unsaturated group more preferably falls within the range of from 1.4 or more to 2.6 or less.

In the present invention, the ratio of the polyester having a polymerizable unsaturated group in the resin constituting the resin fine particle preferably falls within the range of 15.0 mass % or more and 60.0 mass % or less with respect to 100 mass % of all monomers constituting the resin. When the ratio falls within the range, the crosslinked structure based on the polyester having a polymerizable unsaturated group becomes appropriate, and hence the degree of swelling of the resin fine particles can be easily controlled.

Examples of a method of producing the polyester having a polymerizable unsaturated group include the following methods.

(1) A method involving introducing a polymerizable unsaturated group at the time of a polycondensation reaction between a dicarboxylic acid and a diol Examples of the method involving introducing a polymerizable unsaturated group include the following approaches.

(1-1) A method involving using a dicarboxylic acid having a polymerizable unsaturated group as part of the dicarboxylic acid (1-2) A method involving using a diol having a polymerizable unsaturated group as part of the diol (1-3) A method involving using a dicarboxylic acid having a polymerizable unsaturated group and a diol having a polymerizable unsaturated group as part of the dicarboxylic acid and part of the diol, respectively The degree of unsaturation of the polyester having a polymerizable unsaturated group can be adjusted by the addition amount of the dicarboxylic acid or diol having a polymerizable unsaturated group.

Examples of the dicarboxylic acid having a polymerizable unsaturated group include fumaric acid, maleic acid, 3-hexenedioic acid, and 3-octenedioic acid, and lower alkyl esters and acid anhydrides thereof. Of those, fumaric acid and maleic acid are more preferred from the viewpoint of cost. In addition, examples of the aliphatic diol having a polymerizable unsaturated group can include the following compounds: 2-butene-1,4-diol, 3-hexene-1,6-diol, and 4-octene-1,8-diol.

A dicarboxylic acid or diol to be used in ordinary polyester production to be described later can be used as a dicarboxylic acid or diol free of the polymerizable unsaturated group.

(2) A method involving coupling a polyester produced by polycondensation between a dicarboxylic acid and a diol, and a vinyl-based compound In the coupling, a vinyl-based compound containing a functional group capable of reacting with a terminal functional group of the polyester may be directly coupled. In addition, the coupling may be performed after a terminal of the polyester has been modified with a binder so as to be capable of reacting with the functional group contained in the vinyl-based compound. Examples thereof include the following methods.

(2-1) A method involving subjecting a polyester having a carboxyl group at a terminal thereof and a vinyl-based compound containing a hydroxyl group to a condensation reaction In this case, in the preparation of the polyester, the molar ratio (dicarboxylic acid/diol) of the dicarboxylic acid to the diol is preferably 1.02 or more and 1.20 or less.

(2-2) A method involving subjecting a polyester having a hydroxyl group at a terminal thereof and a vinyl-based compound containing an isocyanate group to a urethanization reaction (2-3) A method involving subjecting a polyester having a hydroxyl group at a terminal thereof and a vinyl-based compound having a hydroxyl group to a urethanization reaction with a diisocyanate serving as a binder In the preparation of the polyester to be used in the method described in the item (2-2) or the item (2-3), the molar ratio (diol/dicarboxylic acid) of the diol to the dicarboxylic acid is preferably 1.02 or more and 1.20 or less.

Examples of the vinyl-based compound having a hydroxyl group include hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-buten-3-ol, 2-buten-1-ol, 2-butene-1,4-diol, propargyl alcohol, 2-hydroxyethyl propenyl ether, and sucrose allyl ether. Of those, hydroxyethyl acrylate and hydroxyethyl methacrylate are preferred.

Examples of the vinyl-based compound having an isocyanate group include the following: 2-isocyanatoethyl acrylate, 2-isocyanatoethyl methacrylate, 2-(0-[1'-methylpropylideneamino]carboxyamino)ethyl methacrylate, 2-[(3,5-dimethylpyrazolyl)carbonylamino]ethyl methacrylate, and m-isopropenyl-α,α-dimethylbenzyl isocyanate. Of those, 2-isocyanatoethyl acrylate and 2-isocyanatoethyl methacrylate are particularly preferred.

Examples of the diisocyanate include the following: an aliphatic diisocyanate having 2 or more and 18 or less carbon atoms (excluding a carbon atom in an NCO group, and the same holds true for the following), an alicyclic diisocyanate having 4 or more and 15 or less carbon atoms, an aromatic diisocyanate having 6 or more and or less carbon atoms, and modified products of these diisocyanates (modified products each containing a urethane group, a carbodiimide group, an allophanate group, a urea group, a biuret group, a uretdione group, a uretonimine group, an isocyanurate group, or an oxazolidone group, which are hereinafter sometimes referred to as modified diisocyanates).

Examples of the aromatic diisocyanate include the following: m- and/or p-xylylene diisocyanate (XDI) and α,α,α',α'-tetramethylxylylene diisocyanate.

Examples of the aliphatic diisocyanate include the following: ethylene diisocyanate, tetramethylene diisocyanate, hexamethylene diisocyanate (HDI), and dodecamethylene diisocyanate.

Examples of the alicyclic diisocyanate include the following: isophorone diisocyanate (IPDI), dicyclohexylmethane-4,4'-diisocyanate, cyclohexylene diisocyanate, and methylcyclohexylene diisocyanate.

Of those, XDI, HDI, and IPDI are preferred.

The polyester having a polymerizable unsaturated group is preferably a crystalline polyester having a polymerizable unsaturated group that can adopt a crystal structure. The polyester that can adopt a crystal structure means the following polyester: when many molecules of the polyester itself assemble, the molecules are regularly aligned to express crystallinity. The polyester that can adopt a crystal structure is hereinafter sometimes simply referred to as "crystalline polyester." Such resin shows a clear melting point peak in differential scanning calorimetry with a differential scanning calorimeter (DSC) and is substantially free from softening at temperatures of up to about its melting point, but its melting occurs at a temperature near the melting point to abruptly soften the resin. Therefore, the crystalline polyester accelerates the fixability of the core to facilitate the expression of satisfactory low-temperature fixability.

An aliphatic diol and a polyvalent carboxylic acid each having 4 or more and 20 or less carbon atoms are preferably used as raw materials for the crystalline polyester. Further, the aliphatic diol is desirably linear.

Examples of the linear aliphatic diol to be suitably used in the present invention can include, but not limited to, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, and mixtures thereof may also be used in some cases. Of those, 1,4-butanediol, 1,5-pentanediol, and 1,6-hexanediol are more preferred from the viewpoint of its melting point.

An aromatic dicarboxylic acid and an aliphatic dicarboxylic acid are preferred as the polyvalent carboxylic acid. Of those, an aliphatic dicarboxylic acid is desired, and a linear aliphatic dicarboxylic acid is particularly desired.

Examples of the aliphatic dicarboxylic acid can include, but not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof, and mixtures thereof may also be used in some cases. Of those, sebacic acid, adipic acid, and 1,10-decanedicarboxylic acid, and lower alkyl esters and acid anhydrides thereof are preferred.

Examples of the aromatic dicarboxylic acid can include terephthalic acid, isophthalic acid, 2,6-naphthalenedicarboxylic acid, and 4,4'-biphenyldicarboxylic acid.

A method of producing the crystalline polyester is not particularly limited, and the polyester can be produced by a general polyester polymerization method involving causing the acid monomer and the alcohol monomer to react with each other. For example, the polyester is produced by properly using direct polycondensation and an ester exchange method depending on the kinds of the monomers.

The production of the crystalline polyester is preferably performed at a polymerization temperature of 180° C. or more and 230° C. or less, and the monomers are preferably caused to react with each other under a state in which a pressure in a reaction system is reduced as required while water and an alcohol to be produced at the time of condensation are removed. When the monomers do not dissolve or are not compatible with each other under the reaction temperature, a high-boiling point solvent is desirably added as a solubilizer to dissolve the monomers. A polycondensation reaction is performed while the solubilizer is distilled off. When a monomer having poor compatibility is present in a copolymerization reaction, the monomer having poor compatibility and an acid or alcohol to be subjected to polycondensation with the monomer are preferably condensed in advance before being subjected to the polycondensation together with a main component.

Examples of the catalyst that can be used in producing the crystalline polyester can include: titanium catalysts of titanium tetraethoxide, titanium tetrapropoxide, titanium tetraisopropoxide, and titanium tetrabutoxide; and tin catalysts of dibutyltin dichloride, dibutyltin oxide, and diphenyltin oxide.

The melting point of the crystalline polyester is preferably 50° C. or more and 120° C. or less, and is more preferably 50° C. or more and 90° C. or less in consideration of its melting at a fixation temperature.

In the present invention, the ratio of the crystalline polyester having a polymerizable unsaturated group in the resin constituting the resin fine particle preferably falls within the range of 15.0 mass % or more and 60.0 mass % or less with respect to 100 mass % of all monomers constituting the resin. When the ratio falls within the range, satisfactory low-temperature fixability can be easily expressed.

In the present invention, when the crosslinked structure is introduced by using the monomer having two or more polymerizable unsaturated groups, examples of the monomer having two or more polymerizable unsaturated groups to be used include the following monomers.

There are given polyethylene glycol diacrylate, polypropylene glycol diacrylate, polytetramethylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate, 1,6-hexanediol dimethacrylate, neopentyl glycol dimethacrylate, divinylbenzene, divinylnaphthalene, both-terminal acryl-modified silicone, and both-terminal methacryl-modified silicone.

Of those, a monomer having two or more polymerizable unsaturated groups, the monomer having a weight-average molecular weight of 200 or more and 2,000 or less, is particularly preferred.

As described in the foregoing, the crosslink density depends on the degree of unsaturation and molecular weight of the monomer having two or more polymerizable unsaturated groups to be used, and the ratio of the number of parts of the monomer having two or more polymerizable unsaturated groups to be used to the total number of parts of monomers serving as constituent components for the resin fine particle. Accordingly, in order to appropriately control the crosslink density by such number of parts of the monomer having two or more polymerizable unsaturated groups that the composition of a monomer except the monomer having two or more polymerizable unsaturated groups is not affected, the weight-average molecular weight of the polyfunctional monomer is preferably 200 or more and 2,000 or less.

When the weight-average molecular weight of the monomer having two or more polymerizable unsaturated groups is 200 or more, the crosslink density is not excessively large and hence the resin fine particle can easily swell in the organic solvent. Accordingly, the adhesiveness between the resin fine particles, and the adhesiveness between the resin fine particle and the core particle improve.

Meanwhile, when the weight-average molecular weight of the monomer having two or more polymerizable unsaturated groups is 2,000 or less, the crosslink density becomes moderate and hence the resin fine particle can easily swell in the organic solvent. Accordingly, when the organic solvent is brought into contact with the resin fine particle for forming the shell phase, the agglomeration of the toner particles through intermediation of the resin fine particle is suppressed. Particularly when the monomer is used in the dissolution suspension method, the stability of the resin fine particle against the organic solvent additionally improves, and hence the particle size distribution of the toner to be obtained can easily sharpen.

In the present invention, the ratio of the monomer having two or more polymerizable unsaturated groups in the resin constituting the resin fine particle preferably falls within the range of 1.0 mass % or more and 5.0 mass % or less with respect to 100 mass % of all monomers constituting the resin. When the ratio falls within the range, the crosslinked structure based on the monomer having two or more polymerizable unsaturated groups becomes appropriate, and hence the degree of swelling of the resin fine particles can be easily controlled.

The resin Y is preferably a resin having an organic polysiloxane structure represented by the following formula (i) in its molecular structure. When the resin Y has the organic polysiloxane structure in its molecular structure, the SP value ($SP_Y$) of the resin Y can be easily controlled to 24.0 $(J/cm^3)^{1/2}$ or less, and hence becomes sufficiently close to the SP value ($SP_{SOL}$) of the organic solvent. Thus, the degree of swelling of the resin fine particles can be easily controlled.

Formula (i)

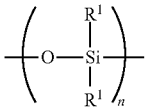

The organic polysiloxane structure is a structure having a repeating unit of a Si—O bond and having two alkyl groups bonded to the Si. In the formula, $R^1$ represents an alkyl group. The number of carbon atoms of the alkyl groups are preferably 1 or more and 3 or less respectively, and the number of carbon atoms of $R^1$ is more preferably 1. In addition, n represents a polymerization degree and represents an integer of 2 or more.

The organic polysiloxane structure has low interfacial tension and is hydrophobic. Accordingly, the structure adsorbs to the surface of the resin solution at the time of granulation in a hydrophobic medium, and hence the dispersion stability can easily improve.

The polymerization degree n is preferably an integer of 2 or more and 100 or less. When the polymerization degree n is 100 or less, the softening of the resin fine particle is suppressed and hence the durability of the toner additionally improves. The polymerization degree is more preferably an integer of 2 or more and 15 or less.

The organic polysiloxane structure can be introduced by: adding a vinyl-modified organic polysiloxane compound represented by the following formula (ii) to the monomer composition together with the polyester having a polymerizable unsaturated group or the monomer having two or more polymerizable unsaturated groups; and polymerizing the composition. In the following formula (ii), $R^2$ and $R^3$ each represent an alkyl group, $R^4$ represents an alkylene group, $R^5$ represents a hydrogen atom or a methyl group, and n represents a polymerization degree and represents an integer of 2 or more.

Formula (ii)

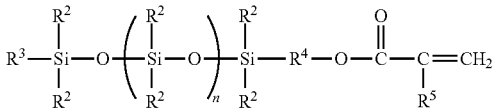

In addition to the monomers, any other vinyl-based monomer may be used in the synthesis of the resin Y.

Aliphatic vinyl hydrocarbons: alkenes, such as ethylene, propylene, butene, isobutylene, pentene, heptene, diisobutylene, octene, dodecene, octadecene, and α-olefins except the olefins; and alkadienes, such as butadiene, isoprene, 1,4-pentadiene, 1,6-hexadiene, and 1,7-octadiene.

Alicyclic vinyl hydrocarbons: mono- or di-cycloalkenes and alkadienes, such as cyclohexene, cyclopentadiene, vinylcyclohexene, and ethylidenebicycloheptene; and terpenes, such as pinene, limonene, and indene.

Aromatic vinyl hydrocarbons: styrene and hydrocarbyl (alkyl, cycloalkyl, aralkyl, and/or alkenyl)-substituted products thereof, such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxyl group-containing vinyl-based monomers and metal salts thereof: unsaturated monocarboxylic acids and unsaturated dicarboxylic acids each having 3 or more and 30 or less carbon atoms, and anhydrides thereof and monoalkyl (having 1 or more and 27 or less carbon atoms) esters thereof, e.g., carboxyl group-containing vinyl-based monomers, such as acrylic acid, methacrylic acid, maleic acid, maleic anhydride, a maleic acid monoalkyl ester, fumaric acid, a fumaric acid monoalkyl ester, crotonic acid, itaconic acid, an itaconic acid monoalkyl ester, an itaconic acid glycol monoether, citraconic acid, a citraconic acid monoalkyl ester, and cinnamic acid.

Vinyl esters, such as vinyl acetate, vinyl butyrate, vinyl propionate, and vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates each having a (linear or branched) alkyl group having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, and 2-ethylhexyl methacrylate), a dialkyl fumarate (fumaric acid dialkyl ester) (two alkyl groups are linear, branched, or alicyclic groups each having 2 or more and 8 or less carbon atoms), a dialkyl maleate (maleic acid dialkyl ester) (two alkyl groups are linear, branched, or alicyclic groups each having 2 or more and 8 or less carbon atoms), polyallyloxyalkanes (diallyloxyethane, triallyloxyethane, tetraallyloxyethane, tetraallyloxypropane, tetraallyloxybutane, and tetramethallyloxyethane), vinyl-based monomers each having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (ethylene oxide is hereinafter abbreviated as EO) 10 mol adduct acrylate, methyl alcohol ethylene oxide (ethylene oxide is hereinafter abbreviated as EO) 10 mol adduct methacrylate, lauryl alcohol EO 30 mol adduct acrylate, and lauryl alcohol EO 30 mol adduct methacrylate), and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate). Of those, as the other vinyl-based monomer, styrene or methacrylic acid is preferably subjected to copolymerization.

The weight-average molecular weight (Mw) of the tetrahydrofuran (THF)-soluble matter of the resin Y determined by gel permeation chromatography (GPC) is desirably 10,000 or more and 80,000 or less. When the weight-average molecular weight falls within the range, the shell has a moderate hardness, and hence its durability improves. When the weight-average molecular weight is 10,000 or more, the durability additionally improves, and when the weight-average molecular weight is 80,000 or less, the fixability additionally improves in some cases.

A method of preparing the resin fine particle is not particularly limited, and a method involving directly obtaining the resin fine particle by an emulsion polymerization method, or a method involving dissolving the resin in a solvent, or melting the resin, to liquefy the resin, and suspending the liquid in an aqueous medium to prepare the fine particle is available. At this time, a known surfactant or dispersant can be used, or self-emulsifiability can be imparted to the resin constituting the fine particle.

A resin to be generally used in a resin particle can be used as the resin X to be used in the resin particle of the present invention.

The resin X to be used in the toner of the present invention is described in detail.

Any one of a crystalline resin and an amorphous resin each serving as a resin to be generally used in a toner can be used as the resin X. The crystalline resin in the resin X is reduced in viscosity after its melting and hence can easily express satisfactory low-temperature fixability.

The melting point of the crystalline resin is preferably 50° C. or more and 90° C. or less.

Examples of the crystalline resin that can be used as the resin X include a crystalline polyester resin, a crystalline polyvinyl resin, a crystalline polyurethane resin, and a crystalline polyurea resin. Of those, a crystalline polyester resin or a crystalline polyvinyl resin is preferably used.

The same resin as that described in the foregoing can be adopted as the crystalline polyester resin.

The crystalline polyvinyl resin is, for example, a resin obtained by polymerizing a vinyl monomer having a linear alkyl group in its molecular structure.

An alkyl acrylate or alkyl methacrylate whose alkyl group has 12 or more carbon atoms is preferred as the vinyl monomer having a linear alkyl group in its molecular structure. Examples thereof can include the following: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, and behenyl methacrylate.

With regard to a method of producing the crystalline polyvinyl resin, the polymerization is preferably performed at a temperature of 40° C. or more, or in general, 50° C. or more and 90° C. or less.

The amorphous resin does not show any clear highest endothermic peak in differential scanning calorimetry. It should be noted that the glass transition point (Tg) of the amorphous resin is preferably 50° C. or more and 130° C. or less, more preferably 55° C. or more and 110° C. or less.

Specific examples of the amorphous resin include an amorphous polyester resin, an amorphous polyurethane resin, an amorphous polyvinyl resin, and an amorphous polyurea resin. In addition, those resins may each be modified with urethane, urea, or epoxy. Of those, an amorphous polyester resin, an amorphous polyvinyl resin, and an amorphous polyurethane resin can be suitably given as examples from the viewpoint of elasticity maintenance.

The amorphous polyester resin is described below. Monomers that can be used in the production of the amorphous polyester resin are, for example, a conventionally known carboxylic acid that is divalent or trivalent or more, and a conventionally known alcohol that is dihydric or trihydric or more. Specific examples of those monomers include the following monomers.

Examples of the divalent carboxylic acid can include the following compounds: dibasic acids, such as succinic acid, adipic acid, sebacic acid, phthalic acid, isophthalic acid, terephthalic acid, malonic acid, dodecenylsuccinic acid, and anhydrides or lower alkyl esters thereof; and aliphatic unsaturated dicarboxylic acids, such as maleic acid, fumaric acid, itaconic acid, and citraconic acid.

In addition, examples of the trivalent or more carboxylic acid can include the following compounds: 1,2,4-benzenetricarboxylic acid, 1,2,5-benzenetricarboxylic acid, and anhydrides or lower alkyl esters thereof. One kind of those carboxylic acids may be used alone, or two or more kinds thereof may be used in combination.

Examples of the dihydric alcohol can include the following compounds: alkylene glycols (ethylene glycol, 1,2-propylene glycol, and 1,3-propylene glycol); alkylene ether glycols (polyethylene glycol and polypropylene glycol); an alicyclic diol (1,4-cyclohexanedimethanol); a bisphenol (bisphenol A); and alkylene oxide (ethylene oxide and propylene oxide) adducts of an alicyclic diol.

An alkyl moiety of each of the alkylene glycol and alkylene ether glycol may be linear or branched. In the present invention, the alkylene glycol having a branched structure can also be preferably used.

In addition, examples of the trihydric or more alcohol may include the following compounds: glycerin, trimethylolethane, trimethylolpropane, and pentaerythritol. One kind of those alcohols may be used alone, or two or more kinds thereof may be used in combination.

It should be noted that monovalent acids, such as acetic acid and benzoic acid, and monohydric alcohols, such as cyclohexanol and benzyl alcohol, can also each be used as required for the purpose of adjusting the acid value or hydroxyl value.

A method of synthesizing the amorphous polyester resin is not particularly limited, but for example, an ester exchange method and a direct polycondensation method can each be used alone, or can be used in combination.

Next, the amorphous polyurethane resin is described. The polyurethane resin is a product of a reaction between a diol and a substance having a diisocyanate group, and a resin having various kinds of functionality can be obtained by adjusting the diol and the diisocyanate.

The same component as that described in the foregoing can be adopted as the diisocyanate component.

The same alcohol as the dihydric alcohol that can be used in the amorphous polyester can be adopted as the diol component that can be used in the polyurethane resin.

The amorphous vinyl resin is described below. The following compounds can be given as monomers that can be used in the production of the amorphous vinyl resin.

Aliphatic vinyl hydrocarbons: alkenes (ethylene, propylene, butene, isobutylene, pentene, heptene, diisobutylene, octene, dodecene, octadecene, and α-olefins except the olefins); and alkadienes (butadiene, isoprene, 1,4-pentadiene, 1,6-hexadiene, and 1,7-octadiene). Alicyclic vinyl hydrocarbons: mono- or di-cycloalkenes and alkadienes (cyclohexene, cyclopentadiene, vinylcyclohexene, and ethylidenebicycloheptene); and terpenes (pinene, limonene, and indene).

Aromatic vinyl hydrocarbons: styrene and hydrocarbyl (alkyl, cycloalkyl, aralkyl, and/or alkenyl)-substituted products thereof (α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene); and vinylnaphthalene.

Carboxyl group-containing vinyl-based monomers and metal salts thereof: unsaturated monocarboxylic acids and unsaturated dicarboxylic acids each having 3 or more and 30 or less carbon atoms, and anhydrides thereof and monoalkyl [having 1 or more and 11 or less carbon atoms] esters thereof (carboxyl group-containing vinyl-based monomers, such as maleic acid, maleic anhydride, a maleic acid monoalkyl ester, fumaric acid, a fumaric acid monoalkyl ester, crotonic acid, itaconic acid, an itaconic acid monoalkyl ester, an itaconic acid glycol monoether, citraconic acid, a citraconic acid monoalkyl ester, and cinnamic acid).

Vinyl esters (vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, and ethyl α-ethoxyacrylate), alkyl acrylates and alkyl methacrylates each having a (linear or branched) alkyl group having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, and 2-ethylhexyl methacrylate), a dialkyl fumarate (fumaric acid dialkyl ester) (two alkyl groups are linear, branched, or alicyclic groups each having 2 or more and 8 or less carbon atoms), a dialkyl maleate (maleic acid dialkyl ester) (two alkyl groups are linear, branched, or alicyclic groups each having 2 or more and 8 or less carbon atoms), polyallyloxyalkanes (diallyloxyethane, triallyloxyethane, tetraallyloxyethane, tetraallyloxypropane, tetraallyloxybutane, and tetramethallyloxyethane), vinyl-based monomers each having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (ethylene oxide is hereinafter abbreviated as EO) 10 mol adduct acrylate, methyl alcohol ethylene oxide (ethylene oxide is hereinafter abbreviated as EO) 10 mol adduct methacrylate, lauryl alcohol EO 30 mol adduct acrylate, and lauryl alcohol EO 30 mol adduct methacrylate), and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Further, in the present invention, the use of a block polymer obtained by chemically bonding a crystalline resin component and an amorphous resin component as the resin X is also one preferred mode.

Examples of the block polymer include a PQ type diblock polymer, a PQP type triblock polymer, a QPQ type triblock polymer, and a PQPQ . . . type multiblock polymer, where P represents the crystalline resin component and Q represents the amorphous resin component, and any one of these forms can be used.

In the present invention, the following methods can each be used as a method of preparing the block polymer: a method involving separately preparing a component forming a crystal portion formed of the crystalline resin component and a component forming an amorphous portion formed of the amorphous resin component, and bonding both the components (two-stage method); and a method involving simultaneously loading raw materials for the component forming the crystal portion and the component forming the amorphous portion to prepare the block polymer in one stage (one-stage method).

The block polymer in the present invention can be prepared by a method selected from various methods in consideration of the reactivity of each of the terminal functional groups of the block polymer.

When both the crystalline resin component and the amorphous resin component are polyester resins, the block polymer can be prepared by separately preparing the respective components and then bonding the components with a binder as required. Particularly when one of the polyesters has a high acid value and the other polyester has a high hydroxyl value, the components can be bonded without the use of any binder. At this time, the reaction is preferably performed at a temperature around 200° C.

When the binder is used, examples thereof include the following binders: a polyvalent carboxylic acid, a polyhydric alcohol, a polyvalent isocyanate, a polyfunctional epoxy, and a polyvalent acid anhydride. The block polymer can be synthesized with any such binder by a dehydration reaction or an addition reaction.

On the other hand, when the crystalline resin component is a polyester resin and the amorphous resin component is a polyurethane resin, the block polymer can be prepared by separately preparing the respective components, and then subjecting an alcohol terminal of the polyester resin and an isocyanate terminal of the polyurethane resin to a urethanization reaction. In addition, the block polymer can be synthesized by mixing the polyester resin having an alcohol terminal, and a diol and diisocyanate constituting the polyurethane resin, and heating the mixture. At the initial stage of a reaction where diol and diisocyanate concentrations are high, the diol and the diisocyanate selectively react with each other to provide the polyurethane resin. After the molecular weight of the resin has increased to some extent, the urethanization reaction between the isocyanate terminal of the polyurethane resin and the alcohol terminal of the polyester resin occurs. Thus, the block polymer can be obtained.

When both the crystalline resin component and the amorphous resin component are vinyl resins, the block polymer can be prepared by polymerizing one of the components and then initiating the polymerization of the other component from a terminal of the resultant vinyl polymer.

The ratio of the crystalline resin component in the block polymer is preferably 50.0 mass % or more, more preferably 70.0 mass % or more.

The following mode is also one preferred mode: the toner particle to be used in the toner of the present invention contains a wax. The wax is not particularly limited but examples thereof include the following waxes.

Aliphatic hydrocarbon-based waxes, such as low-molecular weight polyethylene, low-molecular weight polypropylene, a low-molecular weight olefin copolymer, a microcrystalline wax, a paraffin wax, and a Fischer-Tropsch wax; an oxide of an aliphatic hydrocarbon-based wax, such as a polyethylene oxide wax; a wax containing a fatty acid ester as a main component, such as an aliphatic hydrocarbon-based ester wax; and a wax obtained by deacidifying part or all of fatty acid esters, such as a deacidified carnauba wax; a partially esterified product of a fatty acid and a polyhydric alcohol, such as behenic acid monoglyceride; and a methyl ester compound having a hydroxyl group obtained by subjecting a vegetable oil and fat to hydrogenation.

Of those, an aliphatic hydrocarbon-based wax and an ester wax are particularly preferably used in the toner of the present invention. In addition, the ester wax used in the present invention is preferably a trifunctional or more ester wax, more preferably a tetrafunctional or more ester wax, particularly preferably a hexafunctional or more ester wax.

The ester wax that is trifunctional or more is obtained by, for example, the condensation of an acid that is trivalent or more and a long linear saturated alcohol, or the synthesis of an alcohol that is trihydric or more and a long linear saturated fatty acid.

Examples of the trihydric or more alcohol that can be used in the wax can include glycerin, trimethylolpropane, erythritol, pentaerythritol, and sorbitol. In addition, as condensates thereof, there are given, for example: so-called polyglycerins, such as diglycerin, triglycerin, tetraglycerin, hexaglycerin, and decaglycerin, which are condensates of glycerin; ditrimethylolpropane and tristrimethylolpropane, which are condensates of trimethylolpropane; and dipentaerythritol and trispentaerythritol, which are condensates of pentaerythritol. Of those, a structure having a branched structure is preferred, pentaerythritol or dipentaerythritol is more preferred, and dipentaerythritol is particularly preferred.

Examples of the long-chain linear saturated fatty acid that can be used in the present invention can include caproic acid, caprylic acid, octylic acid, nonylic acid, decanoic acid, dodecanoic acid, lauric acid, tridecanoic acid, myristic acid, palmitic acid, stearic acid, and behenic acid. Of those, myristic acid, palmitic acid, stearic acid, and behenic acid are preferred from the viewpoint of the melting point of the wax.

Examples of the trivalent or more acid that can be used in the present invention can include trimellitic acid and butanetetracarboxylic acid.

Examples of the long-chain linear saturated alcohol that can be used in the present invention can include capryl alcohol, lauryl alcohol, myristyl alcohol, palmityl alcohol, stearyl alcohol, and behenyl alcohol. Of those, myristyl alcohol, palmityl alcohol, stearyl alcohol, and behenyl alcohol are preferred from the viewpoint of the melting point of the wax.

In the toner of the present invention, the content of the wax in the toner is preferably 1.0 part by mass or more and 20.0 parts by mass or less, more preferably 2.0 parts by mass or more and 15.0 parts by mass or less with respect to 100.0 parts by mass of the toner particle.

The wax preferably has a highest endothermic peak at 60° C. or more and 120° C. or less in measurement with a differential scanning calorimeter (DSC). The wax more preferably has the peak at 60° C. or more and 90° C. or less.

In the toner of the present invention, the toner contains a colorant. Examples of the colorant that is preferably used in the present invention include an organic pigment, an organic dye, an inorganic pigment, carbon black serving as a black colorant, and a magnetic particle. In addition to the foregoing, a colorant that has hitherto been used in a toner can be used.

Examples of the yellow colorant include the following: a condensed azo compound, an isoindolinone compound, an anthraquinone compound, an azo metal complex, a methine compound, and an arylamide compound. Specifically, C.I. Pigment Yellow 12, 13, 14, 15, 17, 62, 74, 83, 93, 94, 95, 109, 110, 111, 128, 129, 147, 155, 168, and 180 are suitably used.

Examples of the magenta colorant include the following: a condensed azo compound, a diketopyrrolopyrrole compound, anthraquinone, a quinacridone compound, a base dye lake compound, a naphthol compound, a benzimidazolone compound, a thioindigo compound, and a perylene compound. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 are suitably used.

Examples of the cyan colorant include the following: a copper phthalocyanine compound and derivatives thereof, an anthraquinone compound, and a base dye lake compound. Specifically, C.I. Pigment Blue 1, 7, 15, 15:1, 15:2, 15:3, 15:4, 60, 62, and 66 are suitably used.

The colorant to be used in the toner of the present invention is selected from the viewpoints of a hue angle, chroma, lightness, light fastness, OHP transparency, and dispersibility in the toner.

The colorant is preferably used by being added in an amount of 1.0 part by mass or more and 20.0 parts by mass or less with respect to 100.0 parts by mass of the toner particle. When the magnetic particle is used as the colorant, the addition amount is preferably 40.0 parts by mass or more and 150.0 parts by mass or less with respect to 100.0 parts by mass of the toner particle.

In the toner of the present invention, a charge control agent may be incorporated into the toner particle as required, or may be externally added to the toner particle. The blending of the charge control agent stabilizes the charging characteristic of the toner, and hence can control its triboelectric charge quantity to an optimum value in accordance with a developing system.

A known charge control agent can be utilized as the charge control agent, and a charge control agent having a high charging speed and capable of stably maintaining a constant charge quantity is particularly preferred.

Examples of the charge control agent that controls the toner so that the toner may be negatively chargeable include the following compounds. An organometallic compound and a chelate compound are effective, and examples thereof include a monoazo metal compound, an acetylacetone metal compound, and aromatic oxycarboxylic acid-, aromatic dicarboxylic acid-, oxycarboxylic acid-, and dicarboxylic acid-based metal compounds. Examples of the charge control agent that controls the toner so that the toner may be positively chargeable include the following compounds: nigrosine, a quaternary ammonium salt, a metal salt of a higher fatty acid, diorganotin borates, a guanidine compound, and an imidazole compound.

The blending amount of the charge control agent is preferably 0.01 part by mass or more and 20.0 parts by mass or less, more preferably 0.5 part by mass or more and 10.0 parts by mass or less with respect to 100.0 parts by mass of the toner particle.

In the toner of the present invention, an inorganic fine particle is preferably added as a flowability improver to the toner particle. Examples of the inorganic fine particle to be added to the toner particle include fine particles, such as a silica fine particle, a titanium oxide fine particle, an alumina fine particle, and double oxide fine particles thereof. Of the inorganic fine particles, a silica fine particle and a titanium oxide fine particle are preferred.

Examples of the silica fine particles include dry silica or fumed silica produced by the vapor phase oxidation of a silicon halide and wet silica produced from water glass. Of those, dry silica, which has a small number of silanol groups on the surface and inside of the silica fine particles and has small amounts of $Na_2O$ and $SO_3^{2-}$. In addition, the dry silica may be composite fine particles of silica and any other metal oxide produced by using a metal halide, such as aluminum chloride or titanium chloride, together with a silicon halide in the production process for the dry silica.

The inorganic fine particle is preferably externally added to the toner particle for improving the flowability of the toner and uniformizing the charging of the toner particle. In addition, an inorganic fine particle subjected to a hydrophobic treatment are more preferably used because the adjustment of the charge quantity of the toner, an improvement in its environmental stability, and improvements in its characteristics under a high-humidity environment can be achieved by subjecting the inorganic fine particle to the hydrophobic treatment. When the inorganic fine particle added to the toner absorbs moisture, the charge quantity of the toner reduces, and hence reductions in its developability and transferability are liable to occur.

As a treatment agent for the hydrophobic treatment of the inorganic fine particle, there are given an unmodified silicone varnish, various modified silicone varnishes, an unmodified silicone oil, various modified silicone oils, a silane compound, a silane coupling agent, other organosilicon compounds, and an organotitanium compound. One kind of those treatment agents may be used alone, or two or more kinds thereof may be used in combination.

The addition amount of the inorganic fine particle is preferably 0.1 part by mass or more and 4.0 parts by mass or less, more preferably 0.2 part by mass or more and 3.5 parts by mass or less with respect to 100.0 parts by mass of the toner particle.

Methods of producing the resin particle and toner of the present invention are not particularly limited, but examples thereof include a dissolution suspension method, a suspension polymerization method, an emulsion agglomeration method, and a pulverization method. Of those, a dissolution suspension method by which a resin particle and a toner particle each having a core-shell structure can each be prepared in one stage is particularly preferred.

The formation of the shell phase by the dissolution suspension method in each of the resin particle and toner of the present invention can be performed in accordance with the steps (a) to (c).

Water or carbon dioxide can be used as the dispersion medium in the step (b), and carbon dioxide in a high-pressure state is particularly preferred.

In this case, the carbon dioxide in a high-pressure state is preferably carbon dioxide having a pressure of 1.5 MPa or more. In addition, carbon dioxide in a liquid or supercritical state may be used alone as the dispersion medium, or an organic solvent may be incorporated as any other component. In this case, the carbon dioxide in a high-pressure state and the organic solvent preferably form a homogeneous phase.

Methods of producing the resin particle and the toner each involving using a dispersion medium containing carbon dioxide in a high-pressure state suitable as the production methods of the present invention are given as examples and described below.

First, in the step (a), the colorant, the wax, and any other additive are added as required to the organic solvent capable of dissolving the resin X, and are homogeneously dissolved or dispersed with a dispersing machine, such as a homogenizer, a ball mill, a colloid mill, or an ultrasonic dispersing machine.

Next, in the step (b), the resin solution thus obtained and the carbon dioxide in a high-pressure state are mixed to form the droplet of the resin solution.

At this time, a dispersant needs to be dispersed in the dispersion medium containing the carbon dioxide in a high-pressure state. The dispersant is, for example, a resin fine particle having a predefined degree of swelling.

In addition, a dispersion stabilizer in a liquid state may be added. Examples of the dispersion stabilizer include: a compound having the organic polysiloxane structure or fluorine, the compound having a high affinity for carbon dioxide; and various surfactants, such as a nonionic surfactant, an anionic surfactant, and a cationic surfactant. Any such dispersion stabilizer is discharged to the outside of a system together with carbon dioxide in a desolvating step to be described later. Therefore, after the production of the resin particle and the toner particle, the amount of the dispersion stabilizer remaining in each of the resin particle and the toner particle becomes extremely small.

In the present invention, any method may be used as a method of dispersing the dispersant in the dispersion medium containing the carbon dioxide in a high-pressure state. The method is specifically, for example, a method involving loading the dispersant and the dispersion medium containing the carbon dioxide in a high-pressure state into a container, and directly dispersing the dispersant through stirring or ultrasonic irradiation. Also available is, for example, a method involving introducing, into a container loaded with the dispersion medium containing the carbon dioxide in a high-pressure state, a dispersion liquid, which is obtained by dispersing the dispersant in the organic solvent, with a high-pressure pump.

In addition, in the present invention, any method may be used as a method of dispersing the resin solution in the dispersion medium containing the carbon dioxide in a high-pressure state. The method is specifically, for example, a method involving introducing, into a container loaded with the dispersion medium containing the carbon dioxide in a high-pressure state, the dispersion medium being in a state in which the dispersant has been dispersed therein, the resin solution with a high-pressure pump. In addition, the dispersion medium containing the carbon dioxide in a high-pressure state, the dispersion medium being in a state in which the dispersant has been dispersed therein, may be introduced into a container loaded with the resin solution.

In the present invention, it is important that the dispersion medium containing the carbon dioxide in a high-pressure state be of a single phase. When granulation is performed by dispersing the resin solution in the carbon dioxide in a high-pressure state, part of the organic solvent in the droplet migrates to the inside of a dispersion. At this time, a situation where the phase of the carbon dioxide and the phase of the organic solvent are present under a state of being separated from each other is not preferred because the situation is responsible for the impairment of the stability of the droplet. Therefore, the temperature and pressure of the dispersion medium, and the amount of the resin solution with respect to the carbon dioxide in a high-pressure state are preferably adjusted to fall within such ranges that the carbon dioxide and the organic solvent can form a homogeneous phase.

In addition, with regard to the temperature and pressure of the dispersion medium, attention needs to be paid to a granulation property (the ease with which the droplet is formed) and the solubility of each constituent component in the resin solution in the dispersion medium. For example, the resin X and the wax in the resin solution may dissolve in the dispersion medium depending on a temperature condition and a pressure condition. In general, as the temperature and pressure reduce, the solubility of each of the components in the dispersion medium is suppressed, but the formed droplets are liable to agglomerate and coalesce, thereby reducing the granulation property. On the other hand, as the temperature and the pressure increase, the granulation property improves but the following tendency is observed: the components are liable to dissolve in the dispersion medium. Therefore, in the production of the toner particle of the present invention, the temperature of the dispersion medium preferably falls within the temperature range of from 10° C. to 40° C.

In addition, a pressure in a container where the droplet is formed is preferably 1.5 MPa or more and 20.0 MPa or less, more preferably 2.0 MPa or more and 15.0 MPa or less. It should be noted that when the dispersion medium contains a component except the carbon dioxide, the pressure in the present invention means the total pressure of the components in the dispersion medium.

After the formation of the droplet has thus been completed, in the step (c), the organic solvent remaining in the droplet is removed through the dispersion medium based on the carbon dioxide in a high-pressure state. Specifically, the removal is performed by: further mixing the dispersion medium having dispersed therein the droplet with the carbon dioxide in a high-pressure state to extract the remaining organic solvent to the phase of the carbon dioxide; and further replacing the carbon dioxide containing the organic solvent with the carbon dioxide in a high-pressure state.

With regard to the mixing of the dispersion medium and the carbon dioxide in a high-pressure state, carbon dioxide having a higher pressure than that of the dispersion medium may be added to the dispersion medium, or the dispersion medium may be added to carbon dioxide having a lower pressure than that of the dispersion medium.

In addition, a method of further replacing the carbon dioxide containing the organic solvent with the carbon dioxide in a high-pressure state is, for example, a method involving flowing the carbon dioxide in a high-pressure state while keeping the pressure in the container constant. At this time, the replacement is performed while the resin particle and toner particle to be formed are captured with a filter.

When the replacement with the carbon dioxide in a high-pressure state is insufficient and hence the organic solvent is in a state of remaining in the dispersion medium, upon decompression of the container for recovering the resultant resin particle and toner particle, the following inconvenience may occur: the organic solvent dissolved in the dispersion medium condenses to cause the redissolution of the resin particle and the toner particle, or to cause the coalescence of the resin particles and the toner particles. Therefore, the replacement with the carbon dioxide in a high-pressure state needs to be performed until the organic solvent is completely removed. The amount of the carbon dioxide in a high-pressure state to be flowed is preferably 1 times or more and 100 times or less, more preferably 1 times or more and 50 times or less, most preferably 1 times or more and 30 times or less as large as the volume of the dispersion medium.

When the resin particle and the toner particle are removed from the dispersion containing the carbon dioxide in a high-pressure state, the dispersion having dispersed therein the resin particle and the toner particle, by decompressing the container, the container may be decompressed to normal temperature and normal pressure in one stroke, or the decompression may be performed in a stepwise manner by arranging a plurality of containers whose pressures have been independently controlled. A decompression rate is preferably set to fall within such a range that the resin particle and the toner particle are prevented from foaming.

It should be noted that the organic solvent and carbon dioxide to be used in the present invention can be recycled.

In an aqueous dissolution suspension method, the resin particle and the toner particle can be obtained by: dispersing the resin solution in an aqueous medium having dispersed therein the resin fine particle serving as a shell; and removing the organic solvent.

Water may be used alone as the aqueous medium, but a solvent miscible with water can be used in combination with water. Examples of the miscible solvent include alcohols (methanol, isopropanol, and ethylene glycol), dimethylformamide, tetrahydrofuran, cellosolves (methyl cellosolve), and lower ketones (acetone and 1-butanone).

In addition, a dispersant is added to the aqueous medium. In addition to the resin fine particles described above, any known surfactant, polymer dispersant, and inorganic fine particles may be used as the dispersant.

Examples of the surfactant include an anionic surfactant, a cationic surfactant, an ampholytic surfactant, and a nonionic surfactant, and the surfactant can be optionally selected depending on polarity in the formation of the resin particle and the toner particle.

Examples of the anionic surfactant include an alkylbenzene sulfonate, an α-olefin sulfonate, and a phosphate ester.

In addition, examples of the cationic surfactant include an aliphatic primary, secondary, or secondary amine acid having a fluoroalkyl group, an aliphatic quaternary ammonium salt, such as a perfluoroalkyl(C6-C10)sulfonamide propyltrimethylammonium salt, benzalkonium salt, a benzethonium chloride, a pyridinium salt, and an imidazolinium salt.

In addition, examples of the nonionic surfactant include a fatty acid amide derivative and a polyhydric alcohol derivative.

Examples of the ampholytic surfactant include alanine, dodecyldi(aminoethyl)glycine, di(octylaminoethyl)glycine, and N-alkyl-N,N-dimethylammonium betaine.

In addition, a polymer dispersant may be used as the dispersant. Examples thereof include acids, such as acrylic acid, methacrylic acid, α-cyanoacrylic acid, α-cyanomethacrylic acid, itaconic acid, crotonic acid, fumaric acid, maleic acid, and maleic anhydride. Alternatively, examples thereof include an acrylic monomer and a methacrylic monomer each containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate ester, diethylene glycol monomethacrylate ester, glycerin monoacrylate ester, glycerin monomethacrylate ester, N-methylol acrylamide, and N-methylol methacrylamide. Next, examples thereof include vinyl alcohol and ethers with vinyl alcohol, such as vinyl methyl ether, vinyl ethyl ether, and vinyl propyl ether. Alternatively, examples thereof include esters of vinyl alcohol and compounds each containing a carboxyl group, such as vinyl acetate, vinyl propionate, and vinyl butyrate, and acrylamide, methacrylamide, and diacetone acrylamide. In addition, examples thereof include acid chlorides, such as acrylic chloride and methacrylic chloride. Next, examples thereof include homopolymers and copolymers each having a nitrogen atom of vinylpyridine, vinylpyrrolidone, vinylimidazole, or ethylenimine, or a heterocycle thereof.

In addition, examples thereof include polyoxyethylene-based compounds, such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester. In addition, celluloses, such as methyl cellulose, hydroxyethyl cellulose, and hydroxypropyl cellulose, can be used.

It is preferred that the inorganic fine particle can be removed by an acid having no affinity for a solvent because the resin particle and the toner particle are granulated under a state in which the resin particle and the toner particle adhere to the surface of the particle, and for example, calcium carbonate, calcium chloride, sodium hydrogen carbonate, potassium hydrogen carbonate, sodium hydroxide, potassium hydroxide, hydroxyapatite, and tribasic calcium phosphate can be used.

When a dispersant except the resin fine particle is used, the dispersant can be left remaining on the surface of the toner particle, but is preferably removed by washing in terms of the charging of the toner.

In addition, in the present invention, it is also preferred that a surfactant effect be expressed by dissociating a carboxylic acid residue of the polyester in the resin X. Specifically, the carboxylic acid of the polyester can be dissociated by causing an amine to be present in the oil phase or aqueous phase. The amine that can be used at this time is preferably an amine having a relatively low molecular weight, such as ammonia water, triethylamine, or triethanolamine.

The method of dispersing the resin solution in the dispersion medium is not particularly limited, and a general-purpose apparatus, such as a low-speed shearing type, high-speed shearing type, friction type, high-pressure jet type, or ultrasonic apparatus, can be used. Of those, a high-speed shearing type apparatus is preferred, and an apparatus that has been used as an emulsifier or a dispersing machine for general purposes can be used.

Examples thereof include: a continuous emulsifier, such as ULTRA-TURRAX (manufactured by IKA Works Inc.), Polytron (manufactured by Kinematica Inc.), TK-AUTO-HOMOMIXER (manufactured by Tokushu Kika Kogyo Co., Ltd.), Ebara Milder (manufactured by Ebara Corporation), TK-HOMOMIC LINE FLOW (manufactured by Tokushu Kika Kogyo Co., Ltd.), Colloid Mill (manufactured by Shinko Pantech Co., Ltd.), Slasher, Trigonal wet milling machine (manufactured by Mitsui Miike Machinery Co., Ltd.), Cavitron (manufactured by Eurotech Co., Ltd.), or Fine-Flow Mill (manufactured by Pacific Machinery & Engineering Co., Ltd.); and a batch-type or continuous dual emulsifier, such as Clearmix (manufactured by M Technique Co., Ltd.) or FILMICS (manufactured by Tokushu Kika Kogyo Co., Ltd.).

When the high-speed shearing type dispersing machine is used, its number of revolutions, which is not particularly limited, is typically 1,000 rpm or more and 30,000 rpm or less, preferably 3,000 rpm or more and 20,000 rpm or less. In the case of a batch-type machine, a dispersion time is typically 0.1 minute or more and 5 minutes or less. A temperature at the time of dispersion is typically 10° C. or more and 55° C. or less, preferably 10° C. or more and 40° C. or less.

The weight-average particle diameter (D4) of the toner of the present invention is preferably 3.0 μm or more and 8.0 μm or less, more preferably 5.0 μm or more and 7.0 μm or less. The toner having such weight-average particle diameter (D4) is preferably used for sufficiently satisfying dot reproducibility while making the handleability of the toner satisfactory. The ratio (D4/D1) of the weight-average particle diameter (D4) of the resultant toner to the number-average particle diameter (D1) thereof is preferably less than 1.30.

Methods of measuring respective physical property values specified in the present invention are described below.

<Method of Measuring Number-Average Particle Diameter of Resin Fine Particles>

In the present invention, the number-average particle diameter of the resin fine particles is measured with Zeta Sizer Nano-ZS (manufactured by Malvern Instruments Ltd.). First, samples are prepared as described below. Dispersion liquids of the resin fine particles in water and an organic solvent are each diluted so as to have a solid-liquid ratio of 0.10 mass % (±0.02 mass %), and their temperatures are adjusted to a temperature at the time of granulation. The dispersion liquids of the resin fine particles in water and the organic solvent thus adjusted are each collected in a quartz cell and loaded into a measuring portion. The refractive index of each of the resin fine particles, and the refractive index and viscosity of the dispersion solvent are input as measurement conditions, and the measurement is performed at the temperature at the time of the granulation.

<Method of Calculating Degree of Swelling of Resin Fine Particles>

The degree of swelling of the resin fine particles in the present invention represents a value obtained by dividing the volume of the resin fine particles when the resin fine particles are dispersed in an organic solvent by the volume of the resin fine particles when the resin fine particles are dispersed in water, i.e., a volume ratio. The degree of swelling is calculated from the following formula (11) where A (nm) represents the number-average particle diameter of the resin fine particles when the resin fine particles are dispersed in water and B (nm) represents the number-average particle diameter of the resin fine particles when the resin fine particles are dispersed in the organic solvent.

$$\text{Degree of swelling}=(4\pi(B/2)^3/3)/(4\pi(A/2)^3/3) \quad (11)$$

<Method of Measuring Average Number of Polymerizable Unsaturated Groups in One Molecule of Polyester or Polyurethane Having Polymerizable Unsaturated Group>

The measurement of the average number of polymerizable unsaturated groups in a polyester or polyurethane having a polymerizable unsaturated group is performed by $^1$H-NMR under the following conditions.

Measuring apparatus: FT NMR apparatus JNM-EX400 (manufactured by JEOL Ltd.)
Measuring frequency: 400 MHz
Pulse condition: 5.0 μs
Frequency range: 10,500 Hz
Cumulated number: 64 times
Measuring temperature: 30.0° C.

A sample is prepared by: loading 50.0 mg of the polyester or polyurethane having a polymerizable unsaturated group into a sample tube having an inner diameter of 5.0 mm; adding deuterated chloroform ($CDCl_3$) as a solvent to the tube; and dissolving the polyester or polyurethane in a thermostat at 40.0° C.

The $^1$H-NMR spectrum of the sample is measured and peak information to be assigned to the following units is acquired.

(1) A unit Y1 derived from a compound having a polymerizable unsaturated group
(2) A unit Y2 derived from a diol free of any polymerizable unsaturated group
(3) A unit Y3 derived from a dicarboxylic acid or diisocyanate free of any polymerizable unsaturated group The compound having a polymerizable unsaturated group includes the diol having a polymerizable unsaturated group, the dicarboxylic acid having a polymerizable unsaturated group, the vinyl-based compound having a hydroxyl group, and the vinyl-based compound having an isocyanate group.

An inherent peak P1 that does not coincide with any other unit is selected from peaks to be assigned to the unit Y1, and an integrated value S1 of the selected peak P1 is calculated.

An inherent peak P2 that does not coincide with any other unit is selected from peaks to be assigned to the unit Y2, and an integrated value S2 of the selected peak P2 is calculated.

An inherent peak P3 that does not coincide with any other unit is selected from peaks to be assigned to the unit Y3, and an integrated value S3 of the selected peak P3 is calculated.

The average number of polymerizable unsaturated groups in one molecule of the polyester or polyurethane having a polymerizable unsaturated group is determined in accordance with the following formula (8) by using the integrated value S1, the integrated value S2, and the integrated value S3.

$$\text{Average number of polymerizable unsaturated groups in one molecule of polyester or polyurethane having polymerizable unsaturated group}=\{Mpx(S1/n1)\}/\{M1\times(S1/n1)+M2\times(S2/n2)+M3\times(S3/n3)\} \quad (8)$$

It should be noted that n1, n2, and n3 represent the numbers of hydrogen atoms in the units Y1, Y2, and Y3, respectively, M1, M2, and M3 represent the molecular weights of the units Y1, Y2, and Y3, respectively, and Mp represents the molecular weight of the polyester or polyurethane having a polymerizable unsaturated group.

<Measurement Method for Weight-Average Particle Diameter (D4) and Number-Average Particle Diameter (D1) of Resin Particles and Toner>

The weight-average particle diameter (D4) and number-average particle diameter (D1) of the resin particles and the toner are calculated as described below. A precision particle size distribution measuring apparatus based on a pore electrical resistance method provided with a 100-μm aperture tube "Coulter Counter Multisizer 3" (trademark, manufactured by Beckman Coulter, Inc.) is used as a measuring apparatus. Dedicated software included with the apparatus "Beckman Coulter Multisizer 3 Version 3.51" (manufactured by Beckman Coulter, Inc.) is used for setting measurement conditions and analyzing measurement data. It should be noted that the measurement is performed at a number of effective measurement channels of 25,000.

An electrolyte aqueous solution prepared by dissolving reagent grade sodium chloride in ion-exchanged water so as to have a concentration of about 1 mass %, for example, "ISOTON II" (manufactured by Beckman Coulter, Inc.) can be used in the measurement.

It should be noted that the dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) About 200 ml of the electrolyte aqueous solution is charged into a 250-ml round-bottom glass beaker dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture" function of the analysis software.

(2) About 30 ml of the electrolyte aqueous solution is charged into a 100-ml flat-bottom glass beaker. About 0.3 ml of a diluted solution prepared by diluting "Contaminon N" (a 10 mass % aqueous solution of a neutral detergent for washing a precision measuring device containing a nonionic surfactant, an anionic surfactant, and an organic builder and having a pH of 7, manufactured by Wako Pure Chemical Industries, Ltd.) with ion-exchanged water by three mass fold is added as a dispersant to the electrolyte aqueous solution.

(3) An ultrasonic dispersing unit "Ultrasonic Dispersion System Tetora 150" (manufactured by Nikkaki Bios Co., Ltd.) is prepared in which two oscillators each having an oscillatory frequency of 50 kHz are built so as to be out of phase by 180° and which has an electrical output of 120 W. About 3.3 l of ion-exchange water is charged into the water tank of the ultrasonic dispersing unit. About 2 ml of Contaminon N is added into the water tank.

(4) The beaker in the section (2) is set in the beaker fixing hole of the ultrasonic dispersing unit, and the ultrasonic dispersing unit is operated. Then, the height position of the beaker is adjusted so that the liquid level of the electrolyte aqueous solution in the beaker resonates to the fullest extent possible.

(5) About 10 mg of toner is gradually added to and dispersed in the electrolyte aqueous solution in the beaker in the section (4) under a state in which the electrolyte aqueous solution is irradiated with an ultrasonic wave. Then, the ultrasonic dispersion treatment is continued for an additional 60 seconds. It should be noted that the temperature of water in the water tank is appropriately adjusted to the range of from 10° C. or more to 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) and the number-average particle diameter (D1) are calculated. It should be noted that the "Average Diameter" on the "Analysis/Volume Statistics (Arithmetic Average)" screen of the dedicated software when the dedicated software is set to show a graph in a vol % unit is the weight-average particle diameter (D4), and the "Average Diameter" on the "Analysis/Number Statistics (Arithmetic Average)" screen of the dedicated software when the dedicated software is set to show a graph in a number % unit is the number-average particle diameter (D1).

<Method of Measuring Melting Point of Block Polymer>

The melting point of a block polymer is measured with DSC Q2000 (manufactured by TA Instruments) under the following conditions.

Rate of temperature increase: 10° C./min
Measurement-starting temperature: 20° C.
Measurement-ending temperature: 180° C.

The melting points of indium and zinc are used in the temperature correction of the detecting portion of the apparatus, and the heat of fusion of indium is used in the correction of a heat quantity.

Specifically, about 2 mg of the sample is precisely weighed, loaded into a pan made of aluminum, and subjected to measurement once. An empty pan made of aluminum is used as a reference. The measurement is performed by increasing the temperature to 200° C. once, subsequently decreasing the temperature to 20° C., and then increasing the temperature again. In the case of the block polymer, the peak temperature of the highest endothermic peak of a DSC curve in the temperature range of from 20° C. to 200° C. in the first temperature increase process is defined as the melting point of the block polymer.

<Methods of Measuring Number-Average Molecular Weight (Mn), Peak Molecular Weight (Mp), and Weight-Average Molecular Weight (Mw) of Each of Polyester and Polyurethane Each Having Polymerizable Unsaturated Group, and Block Polymer>

The molecular weight (Mn, Mp, Mw) of the tetrahydrofuran (THF) soluble matter of each of the resins is measured by gel permeation chromatography (GPC) as described below.

First, a sample is dissolved in THF at room temperature over 24 hours. Then, the resultant solution is filtered with a solvent-resistant membrane filter "Myshoridisk" (manufactured by Tosoh Corporation) having a pore diameter of 0.2 μm to provide a sample solution. It should be noted that the concentration of a THF-soluble component in the sample solution is adjusted to 0.8 mass %. Measurement is performed with the sample solution under the following conditions.

Apparatus: HLC 8120 GPC (detector: RI) (manufactured by TOSOH CORPORATION)
Column: Septuplicate of Shodex KF-801, 802, 803, 804, 805, 806, and 807 (manufactured by Showa Denko K.K.)
Eluent: tetrahydrofuran (THF)
Flow rate: 1.0 ml/min
Oven temperature: 40.0° C.
Sample injection amount: 0.10 ml In the calculation of the molecular weight of the sample, a molecular weight calibration curve prepared with standard polystyrene resins (product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Methods of Measuring Particle Diameters of Wax Fine Particles and Colorant Fine Particles>

In the present invention, the particle diameters of wax fine particles and colorant fine particles are measured with a Microtrac particle size distribution-measuring apparatus HRA (X-100) (manufactured by Nikkiso Co., Ltd.) in the preset range of from 0.001 μm to 10 μm, and are measured as volume-average particle diameters (μm or nm). It should be noted that water is selected as a diluent organic solvent.

<Calculation of SP Value ($SP_X$) of Resin X and SP Value ($SP_Y$) of Resin Y>

The SP value ($SP_X$) of the resin X is calculated from a mass ratio between monomers in a monomer composition constituting the resin X with solubility parameter-calculating software (Hansen Solubility Parameters in Practice). A formula for calculating the SP value can be represented by the following formula (9) when the monomers in the monomer composition constituting the resin X are numbered 1 through m (where m represents an integer of 2 or more), $W_m$ represents the mass of each monomer in the monomer composition constituting the resin X, and $SP_m$ represents a SP value of each monomer in the monomer composition constituting the resin X.

$$SP_X(J/CM^3)^{1/2}=\Sigma(W_m\times SP_m)/\Sigma(W_m) \quad (9)$$

The SP value ($SP_Y$) of the resin Y is similarly calculated from a mass ratio between the monomers in the monomer composition constituting the resin Y with the solubility parameter-calculating software (Hansen Solubility Parameters in Practice). A formula for calculating the SP value can be represented by the following formula (10) when the monomers in the monomer composition constituting the resin Y are numbered 1 through n (where n represents an integer of 2 or more), $W_n$ represents the mass of each monomer in the monomer composition constituting the resin Y, and $SP_n$ represents a SP value of each monomer in the monomer composition constituting the resin Y.

$$SP_Y(J/cm^3)^{1/2}=\Sigma(W_n\times SP_n)/\Sigma(W_n) \quad (10)$$

The present invention is more specifically described below by way of Production Examples and Examples. However, the present invention is by no means limited by Production Examples and Examples. It should be noted that all the terms "part(s)" in Production Examples, Examples and Comparative Examples mean "part(s) by mass" unless otherwise stated.

<Synthesis of Polyester 1 Having Polymerizable Unsaturated Group>

The following raw materials were loaded into a two-necked flask that had been heated and dried while nitrogen was introduced into the flask.

| | |
|---|---|
| Sebacic acid | 128.0 parts by mass |
| Fumaric acid | 2.55 parts by mass |
| 1,6-Hexanediol | 78.5 parts by mass |
| Dibutyltin oxide | 0.1 parts by mass |

The system was purged with nitrogen by a decompression operation, and then the mixture was stirred at 180° C. for 6 hours. After that, while the stirring was continued, a temperature was gradually increased to 230° C. under reduced pressure, and was held at the temperature for 2 hours. When the mixture was brought into a viscous state, a reaction was stopped by cooling the mixture with air. Thus, a polyester having a polymerizable unsaturated group was synthesized. The Mn, Mw, and Mp of the polyester having a polymerizable unsaturated group were 19,000, 37,000, and 29,000, respectively, and the average number of polymerizable unsaturated groups in one molecule of the polyester was 2.0.

<Synthesis of Polyesters 2 to 7 Each Having Polymerizable Unsaturated Group>

Polyesters 2 to 7 each having a polymerizable unsaturated group were each prepared in exactly the same manner as in the preparation of the polyester 1 having a polymerizable unsaturated group except that the loading amounts of the monomers to be used were changed as shown in Table 2. The formulations and physical properties of the polyesters each having a polymerizable unsaturated group are shown in Table 1.

<Synthesis of Polyurethane 1 Having Polymerizable Unsaturated Group>

| | |
|---|---|
| Xylylene diisocyanate (XDI) | 52.0 parts by mass |
| Cyclohexane dimethanol (CHDM) | 39.0 parts by mass |
| Tetrahydrofuran (THF) | 100.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. After that, 1.5 parts by mass of hydroxyethyl acrylate was added to the resultant to modify an isocyanate terminal. THF serving as a solvent was distilled off. Thus, a polyurethane 1 having a polymerizable unsaturated group was obtained. The Mn and Mw of the polyurethane were 16,000 and 33,000, respectively, and the average number of polymerizable unsaturated groups in one molecule of the polyurethane was 2.0.

<Preparation of Methacryl-Modified Organic Polysiloxane>

In the present invention, a commercially available one-terminal type vinyl-modified organic polysiloxane shown in Table 2 was prepared, and was used as a methacryl-modified organic polysiloxane. The structure of the methacryl-modified organic polysiloxane is represented by the following formula (ii), and details about $R^2$ to $R^5$ and a value for the polymerization degree n are shown in Table 2.

TABLE 1

| Kind of polyester having polymerizable unsaturated group | Loading amount (part(s) by mass) Sebacic acid | Fumaric acid | 1,6-Hexanediol | Average number of polymerizable unsaturated groups in one molecule | Molecular weight Mn | Mw | Mp |
|---|---|---|---|---|---|---|---|
| Polyester 1 having polymerizable unsaturated group | 128.0 | 2.55 | 78.5 | 2.0 | 19,000 | 37,000 | 29,000 |
| Polyester 2 having polymerizable unsaturated group | 128.0 | 3.48 | 79.5 | 2.6 | 18,000 | 33,000 | 27,000 |
| Polyester 3 having polymerizable unsaturated group | 129.5 | 4.14 | 81.1 | 3.0 | 18,000 | 33,000 | 26,000 |
| Polyester 4 having polymerizable unsaturated group | 128.0 | 2.00 | 78.0 | 1.5 | 18,000 | 32,000 | 26,000 |
| Polyester 5 having polymerizable unsaturated group | 128.0 | 3.90 | 80.0 | 2.8 | 18,000 | 32,000 | 25,000 |
| Polyester 6 having polymerizable unsaturated group | 128.0 | 1.16 | 77.0 | 1.0 | 21,000 | 41,000 | 33,000 |
| Polyester 7 having polymerizable unsaturated group | 129.6 | 4.00 | 80.9 | 3.2 | 20,000 | 38,000 | 30,000 |

Formula (ii)

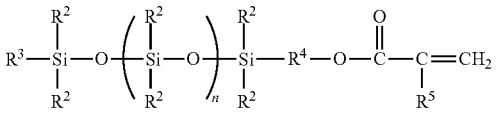

TABLE 2

| | Product name | Manufacturer name | Molecular weight | $R^2$ | $R^3$ | $R^4$ | $R^5$ | Polymerization degree n |
|---|---|---|---|---|---|---|---|---|
| Methacryl-modified organic polysiloxane | X-22-2475 | Shin-Etsu Chemical Co., Ltd | 420 | Methyl group | Methyl group | Propylene group | Methyl group | 3 |

<Preparation of Polyfunctional Monomers 1 to 4>

In the present invention, commercially available polyfunctional monomers (monomers each having two or more polymerizable unsaturated groups) shown in Table 3 were prepared, and were used as polyfunctional monomers 1 to 4. The structures of the polyfunctional monomers 1 to 4 are each represented by the following formula (iii), and the sum of polymerization degrees m and n is shown in Table 3.

Formula (iii)

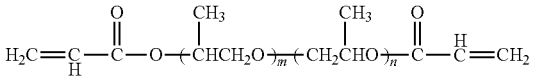

TABLE 3

| | Product name | Manufacturer name | Molecular weight | m + n |
|---|---|---|---|---|
| Polyfunctional monomer 1 | APG400 | Shin-Nakamura Chemical Co., Ltd. | 536 | 7 |
| Polyfunctional monomer 2 | APG100 | Shin-Nakamura Chemical Co., Ltd. | 242 | 2 |
| Polyfunctional monomer 3 | APG200 | Shin-Nakamura Chemical Co., Ltd. | 300 | 3 |
| Polyfunctional monomer 4 | APG700 | Shin-Nakamura Chemical Co., Ltd. | 808 | 11 |

<Preparation of Resin Fine Particle Dispersion Liquid 1>

The following raw materials and 800.0 parts of toluene were loaded into a two-necked flask that had been heated and dried while nitrogen was introduced into the flask. The materials were heated to 70° C. to be completely dissolved.

| | |
|---|---|
| Polyester 1 having a polymerizable unsaturated group | 40.0 parts by mass |
| Methacryl-modified organic polysiloxane (X-22-2475, manufactured by Shin-Etsu Chemical Co., Ltd. (Shin-Etsu Silicone)) | 25.0 parts by mass |
| Stylene | 25.0 parts by mass |
| Methacrylic acid | 10.0 parts by mass |
| Polyfunctional monomer 1 (APG-400, manufactured by Shin-Nakamura Chemical Co., Ltd.) | 2.0 parts by mass |

While being stirred at 250 rpm, the resultant solution was subjected to nitrogen bubbling at 25° C. for 30 minutes. After that, the solution was mixed with 0.6 part by mass of azobismethoxydimethylvaleronitrile serving as a polymerization initiator. After that, the mixture was heated to 75° C. and subjected to a reaction for 6 hours. Further, the mixture was heated to 80° C. and subjected to a reaction for 1 hour. After that, the resultant was cooled with air to provide a dispersion of a particulate resin. Next, the dispersion of the particulate resin was filtered and subjected to ultrasonic dispersion in 200 parts by mass of ion-exchanged water to provide a water dispersion of the particulate resin.

The resultant water dispersion of the particulate resin was loaded into a stirring tank whose temperature could be regulated, and was transferred to CLEAR SS5 (manufactured by M Technique Co., Ltd.) with a pump at a flow rate of 35 g/min to be treated. Thus, a water dispersion of resin fine particles was obtained. Conditions for the treatment of the water dispersion with the CLEAR SS5 were as follows: the peripheral speed of the outermost peripheral portion of the rotating ring-shaped disc of the CLEAR SS5 was set to 15.7 m/s, and a gap between the rotating ring-shaped disc and a fixed ring-shaped disc was set to 1.6 μm. In addition, the temperature of the stirring tank was regulated so that a liquid temperature after the treatment with the CLEAR SS5 became 40° C. or less. The number-average particle diameter (A) of the resin fine particles at the time of their dispersion in water was measured in accordance with the measurement method described in the foregoing. As a result, the number-average particle diameter was 110 nm.

The resin fine particles and water in the water dispersion were separated from each other with a centrifugal separator. Conditions for the centrifugal separation are described below.

Centrifuge: H-9R (manufactured by KOKUSAN Corporation)

Rotor: $B_{N1}$ rotor (manufactured by KOKUSAN Corporation)

Preset temperature in apparatus: 4° C.

Number of rotations: 16,500 rpm

Time: 2.5 hours

After that, a supernatant was removed. Thus, a concentrated dispersion of the resin fine particles was obtained.

In a beaker with a stirring device, the concentrated dispersion of the resin fine particles was dispersed in acetone serving as an organic solvent with a high-power ultrasonic homogenizer (VCX-750). After that, acetone was further added to the resultant. Thus, a resin fine particle dispersion liquid 1 having a solid content concentration of 10% was prepared.

The number-average particle diameter (B) of the resin fine particles at the time of their dispersion in the organic solvent was measured in accordance with the measurement method described in the foregoing. As a result, the number-average particle diameter at 25° C. was 130 nm, and the number-average particle diameter at 40° C. was 140 nm. The degree of swelling of the resin fine particles determined from the number-average particle diameter (A) and the number-average particle diameter (B) at 25° C. and 40° C. were 1.65 and 2.06, respectively.

<Preparation of Resin Fine Particle Dispersion Liquids 2 to 35>

Resin fine particle dispersion liquids 2 to 35 were each prepared in exactly the same manner as in the preparation of the resin fine particle dispersion liquid 1 except that the kinds of the monomers to be used, the loading amounts of the raw materials, and the kind of the organic solvent were changed as shown in Table 4. The physical properties of the resin fine particles in the resin fine particle dispersion liquids are shown in Table 5. In Table 4 and Table 5, the term "MEK" in the column "Kind of organic solvent" means methyl ethyl ketone.

TABLE 4

| | Loading amount (part(s) by mass) | | | | | | | | |
|---|---|---|---|---|---|---|---|---|---|
| Kind of resin fine particle dispersion liquid | Polyfunctional monomer | Methacryl-modified organic polysiloxane | Styrene | Monomer having polymerizable unsaturated group | Meth-acrylic acid | Toluene | Kind of polyfunctional monomer | Kind of organic solvent | Kind of monomer having polymerizable unsaturated group |
| 1 | 2.0 | 25.0 | 25.0 | 40.0 | 10.0 | 800.0 | Polyfunctional monomer 1 | Acetone | Polyester 1 having polymerizable unsaturated group |
| 2 | 2.0 | 25.0 | 25.0 | 40.0 | 10.0 | 800.0 | Polyfunctional monomer 1 | Acetone | Polyester 2 having polymerizable unsaturated group |
| 3 | 0.0 | 25.0 | 25.0 | 40.0 | 10.0 | 800.0 | — | Acetone | Polyester 2 having polymerizable unsaturated group |
| 4 | 2.0 | 25.0 | 25.0 | 40.0 | 10.0 | 800.0 | Polyfunctional monomer 1 | Acetone | Polyester 3 having polymerizable unsaturated group |
| 5 | 2.0 | 25.0 | 25.0 | 40.0 | 10.0 | 800.0 | Polyfunctional monomer 1 | Acetone | Polyurethane 1 having polymerizable unsaturated group |
| 6 | 2.0 | 25.0 | 25.0 | 40.0 | 10.0 | 800.0 | Polyfunctional monomer 1 | Acetone | Polyester 1 having polymerizable unsaturated group |
| 7 | 2.0 | 25.0 | 25.0 | 40.0 | 10.0 | 800.0 | Polyfunctional monomer 1 | Acetone | Polyester 1 having polymerizable unsaturated group |
| 8 | 2.0 | 25.0 | 25.0 | 40.0 | 10.0 | 800.0 | Polyfunctional monomer 1 | Acetone | Polyester 4 having polymerizable unsaturated group |
| 9 | 2.0 | 25.0 | 25.0 | 40.0 | 10.0 | 800.0 | Polyfunctional monomer 1 | Acetone | Polyester 5 having polymerizable unsaturated group |
| 10 | 0.0 | 25.0 | 25.0 | 40.0 | 10.0 | 800.0 | — | Acetone | Polyester 1 having polymerizable unsaturated group |
| 11 | 0.0 | 25.0 | 25.0 | 40.0 | 10.0 | 800.0 | — | Acetone | Polyester 3 having polymerizable unsaturated group |
| 12 | 0.5 | 25.0 | 25.0 | 40.0 | 10.0 | 800.0 | Polyfunctional monomer 1 | Acetone | Polyester 1 having polymerizable unsaturated group |
| 13 | 1.0 | 25.0 | 25.0 | 40.0 | 10.0 | 800.0 | Polyfunctional monomer 1 | Acetone | Polyester 1 having polymerizable unsaturated group |
| 14 | 3.5 | 25.0 | 25.0 | 40.0 | 10.0 | 800.0 | Polyfunctional monomer 1 | Acetone | Polyester 1 having polymerizable unsaturated group |
| 15 | 4.2 | 25.0 | 25.0 | 40.0 | 10.0 | 800.0 | Polyfunctional monomer 1 | Acetone | Polyester 1 having polymerizable unsaturated group |
| 16 | 0.5 | 25.0 | 25.0 | 40.0 | 10.0 | 800.0 | Polyfunctional monomer 1 | Acetone | Polyester 4 having polymerizable unsaturated group |
| 17 | 2.2 | 25.0 | 25.0 | 40.0 | 10.0 | 800.0 | Polyfunctional monomer 1 | Acetone | Polyester 4 having polymerizable unsaturated group |
| 18 | 0.8 | 25.0 | 25.0 | 40.0 | 10.0 | 800.0 | Polyfunctional monomer 1 | Acetone | Polyester 2 having polymerizable unsaturated group |
| 19 | 0.8 | 25.0 | 25.0 | 40.0 | 10.0 | 800.0 | Polyfunctional monomer 1 | Acetone | Polyester 6 having polymerizable unsaturated group |
| 20 | 2.5 | 25.0 | 25.0 | 40.0 | 10.0 | 800.0 | Polyfunctional monomer 1 | Acetone | Polyester 6 having polymerizable unsaturated group |
| 21 | 4.5 | 25.0 | 25.0 | 40.0 | 10.0 | 800.0 | Polyfunctional monomer 1 | Acetone | Polyester 6 having polymerizable unsaturated group |

TABLE 4-continued

| Kind of resin fine particle dispersion liquid | Loading amount (part(s) by mass) | | | | | | Kind of polyfunctional monomer | Kind of organic solvent | Kind of monomer having polymerizable unsaturated group |
|---|---|---|---|---|---|---|---|---|---|
| | Polyfunctional monomer | Methacryl-modified organic polysiloxane | Styrene | Monomer having polymerizable unsaturated group | Meth-acrylic acid | Toluene | | | |
| 22 | 2.0 | 25.0 | 25.0 | 40.0 | 10.0 | 800.0 | Polyfunctional monomer 4 | Acetone | Polyester 1 having polymerizable unsaturated group |
| 23 | 2.0 | 25.0 | 25.0 | 40.0 | 10.0 | 800.0 | Polyfunctional monomer 3 | Acetone | Polyester 1 having polymerizable unsaturated group |
| 24 | 2.0 | 25.0 | 25.0 | 40.0 | 10.0 | 800.0 | Polyfunctional monomer 2 | Acetone | Polyester 1 having polymerizable unsaturated group |
| 25 | 2.0 | 35.0 | 10.0 | 45.0 | 10.0 | 800.0 | Polyfunctional monomer 1 | Acetone | Polyester 1 having polymerizable unsaturated group |
| 26 | 2.0 | 25.0 | 25.0 | 40.0 | 10.0 | 800.0 | Polyfunctional monomer 1 | Ethyl acetate | Polyester 1 having polymerizable unsaturated group |
| 27 | 2.0 | 0.0 | 30.0 | 40.0 | 30.0 | 800.0 | Polyfunctional monomer 1 | Ethyl acetate | Polyester 1 having polymerizable unsaturated group |
| 28 | 2.0 | 0.0 | 30.0 | 40.0 | 30.0 | 800.0 | Polyfunctional monomer 1 | MEK | Polyester 1 having polymerizable unsaturated group |
| 29 | 0.0 | 25.0 | 25.0 | 40.0 | 10.0 | 800.0 | — | Acetone | Polyester 7 having polymerizable unsaturated group |
| 30 | 5.0 | 25.0 | 25.0 | 40.0 | 10.0 | 800.0 | Polyfunctional monomer 1 | Acetone | Polyester 1 having polymerizable unsaturated group |
| 31 | 3.5 | 25.0 | 25.0 | 40.0 | 10.0 | 800.0 | Polyfunctional monomer 1 | Acetone | Polyester 2 having polymerizable unsaturated group |
| 32 | 0.0 | 25.0 | 25.0 | 40.0 | 10.0 | 800.0 | — | Acetone | Polyester 4 having polymerizable unsaturated group |
| 33 | 0.0 | 25.0 | 25.0 | 40.0 | 10.0 | 800.0 | — | Acetone | Polyester 6 having polymerizable unsaturated group |
| 34 | 2.0 | 25.0 | 25.0 | 40.0 | 10.0 | 800.0 | Polyfunctional monomer 2 | Acetone | Polyester 1 having polymerizable unsaturated group |
| 35 | 2.0 | 0.0 | 30.0 | 40.0 | 30.0 | 800.0 | Polyfunctional monomer 1 | Aniline | Polyester 1 having polymerizable unsaturated group |

TABLE 5

| Kind of resin fine particle dispersion liquid | Resin fine particles in resin fine particle dispersion liquid | | | | | | |
|---|---|---|---|---|---|---|---|
| | Number-average particle diameter of primary particles (nm) | | | | SP value of resin fine particles ($SP_Y$) | Organic solvent | |
| | At the time of dispersion in water <A> | At the time of dispersion in organic solvent <B> | Degree of swelling | Measurement temperature (° C.) | | Kind | SP value ($SP_{SOL}$) |
| 1 | 110 | 130 | 1.65 | 25 | 17.1 | Acetone | 19.9 |
| | 110 | 140 | 2.06 | 40 | | | |
| 2 | 110 | 132 | 1.73 | 25 | 17.1 | Acetone | 19.9 |
| | 110 | 143 | 2.20 | 40 | | | |
| 3 | 110 | 121 | 1.33 | 25 | 17.1 | Acetone | 19.9 |
| | 110 | 127 | 1.54 | 40 | | | |
| 4 | 110 | 152 | 2.64 | 25 | 19.0 | Acetone | 19.9 |
| 5 | 110 | 111 | 1.03 | 25 | 17.1 | Acetone | 19.9 |
| | 110 | 121 | 1.33 | 40 | | | |
| 6 | 140 | 179 | 2.09 | 40 | 17.1 | Acetone | 19.9 |
| 7 | 80 | 102 | 2.07 | 40 | 17.1 | Acetone | 19.9 |
| 8 | 110 | 143 | 2.20 | 40 | 17.1 | Acetone | 19.9 |

TABLE 5-continued

| Kind of resin fine particle dispersion liquid | Resin fine particles in resin fine particle dispersion liquid: Number-average particle diameter of primary particles (nm): At the time of dispersion in water <A> | At the time of dispersion in organic solvent <B> | Degree of swelling | Measurement temperature (° C.) | SP value of resin fine particles ($SP_Y$) | Organic solvent: Kind | SP value ($SP_{SOL}$) |
|---|---|---|---|---|---|---|---|
| 9 | 110 | 121 | 1.33 | 40 | 17.1 | Acetone | 19.9 |
| 10 | 110 | 156 | 2.85 | 40 | 17.1 | Acetone | 19.9 |
| 11 | 110 | 125 | 1.47 | 40 | 17.1 | Acetone | 19.9 |
| 12 | 110 | 152 | 2.64 | 40 | 17.1 | Acetone | 19.9 |
| 13 | 110 | 148 | 2.44 | 40 | 17.1 | Acetone | 19.9 |
| 14 | 110 | 129 | 1.61 | 40 | 17.1 | Acetone | 19.9 |
| 15 | 110 | 123 | 1.40 | 40 | 17.1 | Acetone | 19.9 |
| 16 | 110 | 154 | 2.74 | 40 | 17.1 | Acetone | 19.9 |
| 17 | 110 | 141 | 2.11 | 40 | 17.1 | Acetone | 19.9 |
| 18 | 110 | 136 | 1.89 | 40 | 17.1 | Acetone | 19.9 |
| 19 | 110 | 154 | 2.74 | 40 | 17.1 | Acetone | 19.9 |
| 20 | 110 | 141 | 2.11 | 40 | 17.1 | Acetone | 19.9 |
| 21 | 110 | 125 | 1.47 | 40 | 17.1 | Acetone | 19.9 |
| 22 | 110 | 147 | 2.39 | 40 | 17.1 | Acetone | 19.9 |
| 23 | 110 | 124 | 1.43 | 40 | 17.1 | Acetone | 19.9 |
| 24 | 110 | 124 | 1.43 | 40 | 17.1 | Acetone | 19.9 |
| 25 | 110 | 125 | 1.47 | 40 | 16.2 | Acetone | 19.9 |
| 26 | 110 | 152 | 2.64 | 40 | 17.1 | Ethyl acetate | 18.2 |
| 27 | 110 | 156 | 2.85 | 40 | 19.3 | Ethyl acetate | 18.2 |
| 28 | 110 | 152 | 2.64 | 40 | 19.3 | MEK | 19.1 |
| 29 | 110 | 111 | 1.03 | 25 | 17.1 | Acetone | 19.9 |
| 30 | 110 | 117 | 1.20 | 40 | 17.1 | Acetone | 19.9 |
| 31 | 110 | 115 | 1.14 | 40 | 17.1 | Acetone | 19.9 |
| 32 | 110 | 160 | 3.08 | 40 | 17.1 | Acetone | 19.9 |
| 33 | 110 | 164 | 3.31 | 40 | 17.1 | Acetone | 19.9 |
| 34 | 110 | 111 | 1.03 | 40 | 17.1 | Acetone | 19.9 |
| 35 | 110 | 112 | 1.06 | 40 | 19.3 | Aniline | 23.7 |

<Synthesis of Crystalline Polyester 1>

The following raw materials were loaded into a two-necked flask that had been heated and dried while nitrogen was introduced into the flask.

| | |
|---|---|
| Sebacic acid | 124.0 parts by mass |
| 1,6-Hexanediol | 76.0 parts by mass |
| Dibutyltin oxide | 0.1 part by mass |

The system was purged with nitrogen by a decompression operation, and then the mixture was stirred at 180° C. for 6 hours. After that, while the stirring was continued, a temperature was gradually increased to 230° C. under reduced pressure, and was held at the temperature for 2 hours. When the mixture was brought into a viscous state, a reaction was stopped by cooling the mixture with air. Thus, a crystalline polyester 1 was synthesized. The melting point, Mn, and Mw of the crystalline polyester 1 were 73° C., 5,800, and 11,800, respectively.

<Synthesis of Polyurethane 1>

| | |
|---|---|
| Xylylene diisocyanate (XDI) | 52.0 parts by mass |
| Cyclohexane dimethanol (CHDM) | 39.0 parts by mass |
| Tetrahydrofuran (THF) | 100.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. After that, 1.0 part by mass of n-butyl alcohol was added to the resultant to modify an isocyanate terminal. THF serving as a solvent was distilled off. Thus, a polyurethane 1 was obtained. The Mn, Mw, and SP value ($SP_X$) of the polyurethane were 16,000, 32,000, and 22.7 $(J/cm^3)^{1/2}$, respectively.

<Synthesis of Block Polymer 1>

| | |
|---|---|
| Crystalline polyester 1 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. THF serving as a solvent was distilled off. Thus, a block polymer 1 was obtained. The melting point, Mn, Mw, and SP value ($SP_X$) of the block polymer 1 were 65° C., 16,500, 33,500, and 19.3 $(J/cm^3)^{1/2}$, respectively.

<Synthesis of Block Polymer 2>

| | |
|---|---|
| Crystalline polyester 1 | 251.0 parts by mass |
| Xylylene diisocyanate (XDI) | 34.0 parts by mass |
| Cyclohexane dimethanol (CHDM) | 15.0 parts by mass |
| Tetrahydrofuran (THF) | 300.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. THF serving as a solvent was distilled off. Thus, a block polymer 2 was obtained. The melting point, Mn, Mw, and SP value ($SP_X$) of the block polymer 2 were 67° C., 12,900, 31,000, and 18.6 $(J/cm^3)^{1/2}$, respectively.

<Synthesis of Block Polymer 3>

| | |
|---|---|
| Crystalline polyester 1 | 152.0 parts by mass |
| Xylylene diisocyanate (XDI) | 88.0 parts by mass |
| Cyclohexane dimethanol (CHDM) | 60.0 parts by mass |
| Tetrahydrofuran (THF) | 300.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. THF serving as a solvent was distilled off. Thus, a block polymer 3 was obtained. The melting point, Mn, Mw, and SP value ($SP_X$) of the block polymer 3 were 65° C., 15,100, 32,300, and 20.2 $(J/cm^3)^{1/2}$, respectively.

<Synthesis of Block Polymer 4>

| | |
|---|---|
| Crystalline polyester 1 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300.0 parts by mass |

The foregoing materials were loaded into a reaction vessel including a stirring device and a temperature gauge while the vessel was purged with nitrogen. The mixture was heated to 50° C. and subjected to a urethanization reaction over 15 hours. After that, 3.0 parts of salicyclic acid was added to the resultant to modify an isocyanate terminal. THF serving as a solvent was distilled off. Thus, a block polymer 4 was obtained. The melting point, Mn, Mw, and SP value ($SP_X$) of the block polymer 4 were 65° C., 16,700, 33,800, and 19.4 $(J/cm^3)^{1/2}$, respectively.

<Preparation of Resin Solution 1>

128.0 Parts by mass of acetone serving as an organic solvent and 72.0 parts by mass of the block polymer 1 were loaded into a beaker with a stirring device. The mixture was heated to 50° C., and was continuously stirred until the polymer was completely dissolved. Thus, a resin solution 1 was prepared.

<Preparation of Resin Solutions 2 to 7>

Resin solutions 2 to 7 were each prepared in exactly the same manner as in the preparation of the resin solution 1 except that the kinds of the resin and organic solvent to be used were changed as shown in Table 6.

TABLE 6

| Resin solution | Kind of block polymer | Kind of organic solvent |
|---|---|---|
| Resin solution 1 | Block polymer 1 | Acetone |
| Resin solution 2 | Block polymer 2 | Acetone |
| Resin solution 3 | Block polymer 3 | Acetone |
| Resin solution 4 | Block polymer 1 | Ethyl acetate |
| Resin solution 5 | Block polymer 4 | Ethyl acetate |
| Resin solution 6 | Block polymer 4 | Methyl ethyl ketone |
| Resin solution 7 | Block polymer 4 | Aniline |

<Preparation of Colorant Dispersion Liquid 1>

| | |
|---|---|
| C.I. Pigment Blue 15:3 | 100.0 parts by mass |
| Acetone | 150.0 parts by mass |
| Glass beads (1 mm) | 300.0 parts by mass |

The foregoing materials were loaded into a heat-resistant glass container, and were dispersed with PAINT SHAKER (manufactured by Toyo Seiki Seisaku-Sho, Ltd.) for 5 hours, followed by the removal of glass beads with a nylon mesh. Thus, a colorant dispersion liquid 1 having a volume-average particle diameter of 200 nm and a solid content of 40.0 mass % was obtained.

<Preparation of Colorant Dispersion Liquids 2 to 4>

Colorant dispersion liquids 2 to 4 each having a volume-average particle diameter of 210 nm and a solid content of 40.0 mass % were each prepared in exactly the same manner as in the preparation of the colorant dispersion liquid 1 except that the kind of the organic solvent to be used was changed as shown in Table 7.

TABLE 7

| Colorant dispersion liquid | Kind of organic solvent |
|---|---|
| Colorant dispersion liquid 1 | Acetone |
| Colorant dispersion liquid 2 | Ethyl acetate |
| Colorant dispersion liquid 3 | Methyl ethyl ketone |
| Colorant dispersion liquid 4 | Aniline |

<Preparation of Wax Dispersion Liquid 1>

| | |
|---|---|
| Dipentaerythritol palmitate ester wax | 16.0 parts by mass |
| Wax dispersant (copolymer having a peak molecular weight of 8,500 prepared by subjecting 50.0 parts by mass of styrene, 25.0 parts by mass of n-butyl acrylate, and 10.0 parts by mass of acrylonitrile presence of to graft copolymerization in the 15.0 parts by mass of polyethylene) | 8.0 parts by mass |
| Acetone | 76.0 parts by mass |

The foregoing materials were loaded into a glass beaker with a stirring blade (manufactured by Iwaki Glass Co., Ltd.), and the wax was dissolved in acetone by heating the system to 50° C.

Next, the mixture in the system was gradually cooled while being gently stirred under the condition of 50 rpm. The mixture was cooled to 25° C. over 3 hours to provide a milky-white liquid.

The solution was loaded into a heat-resistant glass container together with 20 parts by mass of glass beads each having a diameter of 1 mm, and the materials were dispersed with PAINT SHAKER for 3 hours, followed by the removal of the glass beads with a nylon mesh. Thus, a wax dispersion liquid 1 having a volume-average particle diameter of 270 nm and a solid content of 24.0 mass % was obtained.

<Preparation of Wax Dispersion Liquids 2 to 4>

Wax dispersion liquids 2 to 4 each having a volume-average particle diameter of 270 nm and a solid content of 24.0 mass % were each prepared in exactly the same manner as in the preparation of the wax dispersion liquid 1 except that the kind of the organic solvent to be used was changed as shown in Table 8.

TABLE 8

| Wax dispersion liquid | Kind of organic solvent |
|---|---|
| Wax dispersion liquid 1 | Acetone |
| Wax dispersion liquid 2 | Ethyl acetate |
| Wax dispersion liquid 3 | Methyl ethyl ketone |
| Wax dispersion liquid 4 | Aniline |

Example 1

(Production of Resin Particles 1)

In an apparatus illustrated in FIG. 1, first, valves V1 and V2, and a pressure-adjusting valve V3 were closed. 18.0 Parts of the resin fine particle dispersion liquid 1 was loaded into a pressure-resistant granulation tank T1 including a filter for capturing resin particles and a stirring mechanism, and a temperature in the tank was adjusted to 25° C. Next, the valve V1 was opened, carbon dioxide (purity: 99.99%) was introduced from a carbon dioxide bomb B1 into the granulation tank T1 with a pump P1, and the valve V1 was closed when a pressure in the tank reached 2.0 MPa. Meanwhile, the resin solution 1 was loaded into a resin solution tank T2 and a temperature in the tank was adjusted to 25° C.

Next, the valve V2 was opened, and while the contents in the granulation tank T1 were stirred at 2,000 rpm, the contents in the resin solution tank T2 were introduced into the granulation tank T1 with a pump P2. When the introduction of all the contents was terminated, the valve V2 was closed. The pressure in the granulation tank T1 after the introduction became 3.0 MPa.

It should be noted that the amounts (mass ratio) of the materials to be loaded into the resin solution tank T2 are as described below.

| | |
|---|---|
| Resin solution 1 | 100.0 parts by mass |
| Acetone (organic solvent) | 13.5 parts by mass |

After the introduction of the contents in the resin solution tank T2 into the granulation tank T1 had been terminated, granulation was performed by further stirring the contents at 1,000 rpm for 3 minutes.

Next, the valve V1 was opened, and carbon dioxide was introduced from the carbon dioxide bomb B1 into the granulation tank T1 with the pump P1. At this time, the pressure-adjusting valve V3 was set to 4.0 MPa, and carbon dioxide was further flowed while the pressure in the granulation tank T1 was maintained at 4.0 MPa. Through the foregoing operation, carbon dioxide containing acetone serving as an organic solvent extracted from droplets after the granulation was discharged to a solvent recovery tank T3, and acetone and carbon dioxide were separated from each other.

In addition, after the discharge of carbon dioxide to the solvent recovery tank T3 had been started, acetone in the solvent recovery tank T3 was removed every 5 minutes. The operation was continued until acetone did not accumulate in the solvent recovery tank and hence could not be removed. Desolvation was terminated at the time point when acetone was not removed any longer, and the valve V1 was closed to terminate the flow of carbon dioxide.

Further, the pressure-adjusting valve V3 was opened little by little to reduce the pressure in the granulation tank T1 to atmospheric pressure. Thus, resin particles 1 captured by the filter were obtained. The results of their evaluations are shown in Table 10.

Examples 2 to 5 and Comparative Examples 1 and 2

Resin particles 2 to 5 and comparative resin particles 1 and 2 were obtained in the same manner as in Example 1 except that in Example 1, the kind of the resin fine particle dispersion liquid and the temperature in the granulation tank in the production process for the resin particles 1 were changed as shown in Table 9. Herein, a temperature in the granulation tank was measured by a temperature detecting means, and a temperature displayed in the temperature detecting means was defined as the temperature in the granulation tank. In addition, the resultant resin particles 2 to 5 and comparative resin particles 1 and 2 were subjected to the same evaluations as those of Example 1. The results of the evaluations of the resultant resin particles 2 to 5 and comparative resin particles 1 and 2 are shown in Table 10. It should be noted that in Example 5, the granulation is performed by using the resin fine particle dispersion liquid 5 at a temperature in the granulation tank of 40° C., and hence the degree of swelling of its resin fine particles becomes 1.33. On the other hand, in Comparative Example 1, the granulation is performed by using the resin fine particle dispersion liquid 5 at a temperature in the granulation tank of 25° C., and hence the degree of swelling of its resin fine particles becomes 1.03.

TABLE 9

| | Kind of resin particle material to be used | | | | | | |
|---|---|---|---|---|---|---|---|
| | Resin fine particle dispersion liquid | Resin solution | Kind of dispersion medium | Kind of organic solvent | $\lvert SP_{SOL} - SP_Y \rvert$ | $\lvert (SP_{SOL} + SP_X)/2 - SP_Y \rvert$ | Temperature in granulation tank |
| Example 1 | Resin fine particle dispersion liquid 1 | Resin solution 1 | Carbon dioxide | Acetone | 2.8 | 2.5 | 25 |
| Example 2 | Resin fine particle dispersion liquid 2 | Resin solution 1 | Carbon dioxide | Acetone | 2.8 | 2.5 | 25 |
| Example 3 | Resin fine particle dispersion liquid 3 | Resin solution 1 | Carbon dioxide | Acetone | 2.8 | 2.5 | 25 |
| Example 4 | Resin fine particle dispersion liquid 4 | Resin solution 1 | Carbon dioxide | Acetone | 0.9 | 2.3 | 25 |

TABLE 9-continued

| | Kind of resin particle material to be used | | | | | | |
|---|---|---|---|---|---|---|---|
| | Resin fine particle dispersion liquid | Resin solution | Kind of dispersion medium | Kind of organic solvent | $\lvert SP_{SOL} - SP_Y \rvert$ | $\lvert (SP_{SOL} + SP_X)/2 - SP_Y \rvert$ | Temperature in granulation tank |
| Example 5 | Resin fine particle dispersion liquid 5 | Resin solution 1 | Carbon dioxide | Acetone | 2.8 | 2.5 | 40 |
| Comparative Example 1 | Resin fine particle dispersion liquid 5 | Resin solution 1 | Carbon dioxide | Acetone | 2.8 | 2.5 | 25 |
| Comparative Example 2 | Resin fine particle dispersion liquid 29 | Resin solution 1 | Carbon dioxide | Acetone | 2.8 | 2.5 | 25 |

TABLE 10

| | | Granulation property | | |
|---|---|---|---|---|
| | | Particle size distribution (D4/D1) | D4 (μm) | D1 (μm) |
| Example 1 | Resin particles 1 | 1.14 (B) | 6.61 | 5.80 |
| Example 2 | Resin particles 2 | 1.16 (B) | 6.75 | 5.82 |
| Example 3 | Resin particles 3 | 1.23 (C) | 6.86 | 5.91 |
| Example 4 | Resin particles 4 | 1.28 (D) | 7.24 | 6.24 |
| Example 5 | Resin particles 5 | 1.24 (C) | 6.88 | 5.93 |
| Comparative Example 1 | Comparative resin particles 1 | 1.31 (E) | 8.20 | 6.26 |
| Comparative Example 2 | Comparative resin particles 2 | 1.32 (E) | 8.30 | 6.29 |

Example 6

(Production of Toner Particles 1)

In the apparatus illustrated in FIG. 1, first, the valves V1 and V2, and the pressure-adjusting valve V3 were closed. 18.0 Parts of the resin fine particle dispersion liquid 1 was loaded into the pressure-resistant granulation tank T1 including a filter for capturing toner particles and a stirring mechanism, and a temperature in the tank was adjusted to 40° C. Next, the valve V1 was opened, carbon dioxide (purity: 99.99%) was introduced from the carbon dioxide bomb B1 into the granulation tank T1 with the pump P1, and the valve V1 was closed when a pressure in the tank reached 2.0 MPa. Meanwhile, the resin solution 1, the wax dispersion liquid 1, and the colorant dispersion liquid 1 were loaded into the resin solution tank T2 and a temperature in the tank was adjusted to 40° C.

Next, the valve V2 was opened, and while the contents in the granulation tank T1 were stirred at 2,000 rpm, the contents in the resin solution tank T2 were introduced into the granulation tank T1 with the pump P2. When the introduction of all the contents was terminated, the valve V2 was closed. The pressure in the granulation tank T1 after the introduction became 3.0 MPa.

It should be noted that the amounts (mass ratio) of the materials to be loaded into the resin solution tank T2 are as described below.

| | |
|---|---|
| Resin solution 1 | 100.0 parts by mass |
| Wax dispersion liquid 1 | 10.0 parts by mass |
| Colorant dispersion liquid 1 | 6.0 parts by mass |
| Acetone (organic solvent) | 10.0 parts by mass |

After the introduction of the contents in the resin solution tank T2 into the granulation tank T1 had been terminated, granulation was performed by further stirring the contents at 1,000 rpm for 3 minutes.

Next, the valve V1 was opened, and carbon dioxide was introduced from the carbon dioxide bomb B1 into the granulation tank T1 with the pump P1. At this time, the pressure-adjusting valve V3 was set to 4.0 MPa, and carbon dioxide was further flowed while the pressure in the granulation tank T1 was maintained at 4.0 MPa. Through the foregoing operation, carbon dioxide containing acetone serving as an organic solvent extracted from droplets after the granulation was discharged to the solvent recovery tank T3, and acetone and carbon dioxide were separated from each other.

In addition, after the discharge of carbon dioxide to the solvent recovery tank T3 had been started, acetone in the solvent recovery tank T3 was removed every 5 minutes. The operation was continued until acetone did not accumulate in the solvent recovery tank and hence could not be removed. Desolvation was terminated at the time point when acetone was not removed any longer, and the valve V1 was closed to terminate the flow of carbon dioxide.

Further, the pressure-adjusting valve V3 was opened little by little to reduce the pressure in the granulation tank T1 to atmospheric pressure. Thus, toner particles 1 captured by the filter were obtained.

(Preparation of Toner 1)

100.0 Parts by mass of the toner particles 1 were subjected to dry mixing with 1.8 parts by mass of hydrophobic silica fine powder treated with hexamethyldisilazane (number-average particle diameter: 7 nm) and 0.15 part by mass of rutile type titanium oxide fine powder (number-average particle diameter: 30 nm) for 5 minutes by using a Henschel mixer (manufactured by Mitsui Mining Co., Ltd.). Thus, a toner 1 of the present invention was obtained. The results of its evaluations are shown in Table 12.

Examples 7 to 31 and Comparative Examples 3 to 9

Toners 2 to 26 and comparative toners 1 to 7 were obtained in the same manner as in Example 6 except that in Example 6, the resin solution 1, the colorant dispersion liquid 1, and the wax dispersion liquid 1, and the kind of the organic solvent in the production process for the toner 1 were changed to those shown in Table 11. In addition, the resultant toners 2 to 26 and comparative toners 1 to 7 were subjected to the same evaluations as those of Example 6. The results of the evaluations of the resultant toners 2 to 26 and comparative toners 1 to 7 are shown in Table 12.

Example 32

(Production of Toner Particles 27)

| | |
|---|---|
| Resin solution 5 | 100.0 parts by mass |
| Wax dispersion liquid 2 | 10.0 parts by mass |
| Colorant dispersion liquid 2 | 6.0 parts by mass |

The foregoing materials were loaded into a container, and were stirred and dispersed with HOMODISPER (manufactured by Tokushu Kika Kogyo Co., Ltd.) at 1,500 rpm for 10 minutes. Further, the resultant solution was dispersed under normal temperature with an ultrasonic dispersing machine for 30 minutes. Thus, an oil phase 1 was prepared.

| | |
|---|---|
| Resin fine particle dispersion liquid 27 | 18.0 parts by mass |
| Aqueous solution of 50% sodium dodecyl diphenyl ether disulfonate (ELEMINOL MON-7, Sanyo Chemical Industries, Ltd.) | 15.0 parts by mass |
| Aqueous solution of 1 mass % carboxymethylcellulose | 50.0 parts by mass |
| Propylamine (Kanto Chemical Co., Inc.) | 2.5 parts by mass |
| Ion-exchanged water | 200.0 parts by mass |
| Ethyl acetate (organic solvent) | 10.0 parts by mass |

The foregoing materials were loaded into a container, and were stirred with T.K. Homomixer (manufactured by Tokushu Kika Kogyo Co., Ltd.) at 5,000 rpm for 1 minute. Thus, an aqueous phase 1 was prepared.

The oil phase 1 was loaded into the aqueous phase 1, the number of revolutions of the T.K. Homomixer was increased to 8,000 rpm, and the mixture was continuously stirred at 40° C. for 1 minute. Thus, the oil phase 1 was suspended. Next, a stirring blade was set in the container, and the suspension was stirred under 200 rpm (40° C.) for 30 minutes. Further, while a temperature in the system was maintained at 40° C., desolvation was performed over 5 hours under a state in which a pressure in the system was reduced to 100 mmHg. Thus, a water dispersion liquid of toner particles 27 was obtained.

Next, the water dispersion liquid of the toner particles was filtered and re-slurried in 500 parts by mass of ion-exchanged water. After that, while the system was stirred, hydrochloric acid was added until the pH of the system became 4, followed by stirring for 5 minutes. The slurry was filtered again, 200 parts by mass of ion-exchanged water was added to the filter product, and the mixture was stirred for 5 minutes; the operation was repeated three times to remove triethylamine remaining in the system. Thus, a filter cake of the toner particles was obtained.

The filter cake was dried with a warm-air dryer at 45° C. for 3 days, and was sieved with a mesh having an aperture of 75 μm to provide the toner particles 27.

(Preparation of Toner 27)

100.0 Parts by mass of the toner particles 27 were subjected to dry mixing with 1.8 parts by mass of hydrophobic silica fine powder treated with hexamethyldisilazane (number-average particle diameter: 7 nm) and 0.15 part by mass of rutile type titanium oxide fine powder (number-average particle diameter: 30 nm) for 5 minutes by using a Henschel mixer (manufactured by Mitsui Mining Co., Ltd.). Thus, a toner 27 of the present invention was obtained. The results of its evaluations are shown in Table 12.

Example 33 and Comparative Example 10

A toner 28 and a comparative toner 8 were obtained in the same manner as in Example 32 except that in Example 32, the resin fine particle dispersion liquid 27, the resin solution 5, the colorant dispersion liquid 2, and the wax dispersion liquid 2, the kind of the organic solvent in the production process for the toner 27 were changed to those shown in Table 11. In addition, the resultant toner 28 and comparative toner 8 were subjected to the same evaluations as those of Example 32. The results of the evaluations of the resultant toner 28 and comparative toner 8 are shown in Table 12.

TABLE 11

| | Kind of toner material to be used | | | | | | | | | |
|---|---|---|---|---|---|---|---|---|---|---|
| | Resin fine particle dispersion liquid | Resin solution | Colorant dispersion liquid | Wax dispersion liquid | Kind of dispersion medium | Kind of organic solvent | $\lvert SP_X - SP_Y \rvert$ | $\lvert (SP_{SOL} - (SP_X + SP_Y)/2 \rvert$ | $\lvert (SP_{SOL} + SP_X)/2 - SP_Y \rvert$ | $\lvert SP_{SOL} - SP_Y \rvert$ |
| Example 6 | Resin fine particle dispersion liquid 1 | Resin solution 1 | Colorant dispersion liquid 1 | Wax dispersion liquid 1 | Carbon dioxide | Acetone | 2.2 | 1.7 | 2.5 | 2.8 |
| Example 7 | Resin fine particle dispersion liquid 6 | Resin solution 1 | Colorant dispersion liquid 1 | Wax dispersion liquid 1 | Carbon dioxide | Acetone | 2.2 | 1.7 | 2.5 | 2.8 |
| Example 8 | Resin fine particle dispersion liquid 7 | Resin solution 1 | Colorant dispersion liquid 1 | Wax dispersion liquid 1 | Carbon dioxide | Acetone | 2.2 | 1.7 | 2.5 | 2.8 |
| Example 9 | Resin fine particle dispersion liquid 8 | Resin solution 1 | Colorant dispersion liquid 1 | Wax dispersion liquid 1 | Carbon dioxide | Acetone | 2.2 | 1.7 | 2.5 | 2.8 |

TABLE 11-continued

| | Kind of toner material to be used | | | | | | | | | |
|---|---|---|---|---|---|---|---|---|---|---|
| | Resin fine particle dispersion liquid | Resin solution | Colorant dispersion liquid | Wax dispersion liquid | Kind of dispersion medium | Kind of organic solvent | $\lvert SP_X - SP_Y \rvert$ | $\lvert (SP_{SOL} - (SP_X + SP_Y)/2 \rvert$ | $\lvert (SP_{SOL} + SP_X)/2 - SP_Y \rvert$ | $\lvert SP_{SOL} - SP_Y \rvert$ |
| Example 10 | Resin fine particle dispersion liquid 3 | Resin solution 1 | Colorant dispersion liquid 1 | Wax dispersion liquid 1 | Carbon dioxide | Acetone | 2.2 | 1.7 | 2.5 | 2.8 |
| Example 11 | Resin fine particle dispersion liquid 9 | Resin solution 1 | Colorant dispersion liquid 1 | Wax dispersion liquid 1 | Carbon dioxide | Acetone | 2.2 | 1.7 | 2.5 | 2.8 |
| Example 12 | Resin fine particle dispersion liquid 10 | Resin solution 1 | Colorant dispersion liquid 1 | Wax dispersion liquid 1 | Carbon dioxide | Acetone | 2.2 | 1.7 | 2.5 | 2.8 |
| Example 13 | Resin fine particle dispersion liquid 2 | Resin solution 1 | Colorant dispersion liquid 1 | Wax dispersion liquid 1 | Carbon dioxide | Acetone | 2.2 | 1.7 | 2.5 | 2.8 |
| Example 14 | Resin fine particle dispersion liquid 11 | Resin solution 1 | Colorant dispersion liquid 1 | Wax dispersion liquid 1 | Carbon dioxide | Acetone | 2.2 | 1.7 | 2.5 | 2.8 |
| Example 15 | Resin fine particle dispersion liquid 12 | Resin solution 1 | Colorant dispersion liquid 1 | Wax dispersion liquid 1 | Carbon dioxide | Acetone | 2.2 | 1.7 | 2.5 | 2.8 |
| Example 16 | Resin fine particle dispersion liquid 13 | Resin solution 1 | Colorant dispersion liquid 1 | Wax dispersion liquid 1 | Carbon dioxide | Acetone | 2.2 | 1.7 | 2.5 | 2.8 |
| Example 17 | Resin fine particle dispersion liquid 14 | Resin solution 1 | Colorant dispersion liquid 1 | Wax dispersion liquid 1 | Carbon dioxide | Acetone | 2.2 | 1.7 | 2.5 | 2.8 |
| Example 18 | Resin fine particle dispersion liquid 15 | Resin solution 1 | Colorant dispersion liquid 1 | Wax dispersion liquid 1 | Carbon dioxide | Acetone | 2.2 | 1.7 | 2.5 | 2.8 |
| Example 19 | Resin fine particle dispersion liquid 16 | Resin solution 1 | Colorant dispersion liquid 1 | Wax dispersion liquid 1 | Carbon dioxide | Acetone | 2.2 | 1.7 | 2.5 | 2.8 |
| Example 20 | Resin fine particle dispersion liquid 17 | Resin solution 1 | Colorant dispersion liquid 1 | Wax dispersion liquid 1 | Carbon dioxide | Acetone | 2.2 | 1.7 | 2.5 | 2.8 |
| Example 21 | Resin fine particle dispersion liquid18 | Resin solution 1 | Colorant dispersion liquid 1 | Wax dispersion liquid 1 | Carbon dioxide | Acetone | 2.2 | 1.7 | 2.5 | 2.8 |
| Example 22 | Resin fine particle dispersion liquid 19 | Resin solution 1 | Colorant dispersion liquid 1 | Wax dispersion liquid 1 | Carbon dioxide | Acetone | 2.2 | 1.7 | 2.5 | 2.8 |
| Example 23 | Resin fine particle dispersion liquid 20 | Resin solution 1 | Colorant dispersion liquid 1 | Wax dispersion liquid 1 | Carbon dioxide | Acetone | 2.2 | 1.7 | 2.5 | 2.8 |
| Example 24 | Resin fine particle dispersion liquid 21 | Resin solution 1 | Colorant dispersion liquid 1 | Wax dispersion liquid 1 | Carbon dioxide | Acetone | 2.2 | 1.7 | 2.5 | 2.8 |
| Example 25 | Resin fine particle dispersion liquid 22 | Resin solution 1 | Colorant dispersion liquid 1 | Wax dispersion liquid 1 | Carbon dioxide | Acetone | 2.2 | 1.7 | 2.5 | 2.8 |
| Example 26 | Resin fine particle dispersion liquid 23 | Resin solution 1 | Colorant dispersion liquid 1 | Wax dispersion liquid 1 | Carbon dioxide | Acetone | 2.2 | 1.7 | 2.5 | 2.8 |
| Example 27 | Resin fine particle dispersion liquid 24 | Resin solution 1 | Colorant dispersion liquid 1 | Wax dispersion liquid 1 | Carbon dioxide | Acetone | 2.2 | 1.7 | 2.5 | 2.8 |

TABLE 11-continued

| | Kind of toner material to be used | | | | | | | | | |
|---|---|---|---|---|---|---|---|---|---|---|
| | Resin fine particle dispersion liquid | Resin solution | Colorant dispersion liquid | Wax dispersion liquid | Kind of dispersion medium | Kind of organic solvent | $\lvert SP_X - SP_Y \rvert$ | $\lvert (SP_{SOL} - (SP_X + SP_Y)/2 \rvert$ | $\lvert (SP_{SOL} + SP_X)/2 - SP_Y \rvert$ | $\lvert SP_{SOL} - SP_Y \rvert$ |
| Example 28 | Resin fine particle dispersion liquid 25 | Resin solution 2 | Colorant dispersion liquid 1 | Wax dispersion liquid 1 | Carbon dioxide | Acetone | 2.4 | 2.5 | 3.1 | 3.7 |
| Example 29 | Resin fine particle dispersion liquid 26 | Resin solution 3 | Colorant dispersion liquid 2 | Wax dispersion liquid 2 | Carbon dioxide | Ethyl acetate | 2.2 | 0 | 1.7 | 1.1 |
| Example 30 | Resin fine particle dispersion liquid 1 | Resin solution 4 | Colorant dispersion liquid 1 | Wax dispersion liquid 1 | Carbon dioxide | Acetone | 3.1 | 1.3 | 3.0 | 2.8 |
| Example 31 | Resin fine particle dispersion liquid 1 | Resin solution 1 | Colorant dispersion liquid 1 | Wax dispersion liquid 1 | Carbon dioxide | Acetone | 1.5 | 2.1 | 2.2 | 2.8 |
| Example 32 | Resin fine particle dispersion liquid 27 | Resin solution 5 | Colorant dispersion liquid 2 | Wax dispersion liquid 2 | Water | Ethyl acetate | 0.1 | 1.2 | 0.5 | 1.1 |
| Example 33 | Resin fine particle dispersion liquid 28 | Resin solution 6 | Colorant dispersion liquid 3 | Wax dispersion liquid 3 | Water | MEK | 0.1 | 0.3 | 0.1 | 0.2 |
| Comparative Example 3 | Resin fine particle dispersion liquid 5 | Resin solution 1 | Colorant dispersion liquid 1 | Wax dispersion liquid 1 | Carbon dioxide | Acetone | 2.2 | 1.7 | 2.5 | 2.8 |
| Comparative Example 4 | Resin fine particle dispersion liquid 30 | Resin solution 1 | Colorant dispersion liquid 1 | Wax dispersion liquid 1 | Carbon dioxide | Acetone | 2.2 | 1.7 | 2.5 | 2.8 |
| Comparative Example 5 | Resin fine particle dispersion liquid 31 | Resin solution 1 | Colorant dispersion liquid 1 | Wax dispersion liquid 1 | Carbon dioxide | Acetone | 2.2 | 1.7 | 2.5 | 2.8 |
| Comparative Example 6 | Resin fine particle dispersion liquid 32 | Resin solution 1 | Colorant dispersion liquid 1 | Wax dispersion liquid 1 | Carbon dioxide | Acetone | 2.2 | 1.7 | 2.5 | 2.8 |
| Comparative Example 7 | Resin fine particle dispersion liquid 33 | Resin solution 1 | Colorant dispersion liquid 1 | Wax dispersion liquid 1 | Carbon dioxide | Acetone | 2.2 | 1.7 | 2.5 | 2.8 |
| Comparative Example 8 | Resin fine particle dispersion liquid 34 | Resin solution 1 | Colorant dispersion liquid 1 | Wax dispersion liquid 1 | Carbon dioxide | Acetone | 2.2 | 1.7 | 2.5 | 2.8 |
| Comparative Example 9 | Resin fine particle dispersion liquid 5 | Resin solution 1 | Colorant dispersion liquid 1 | Wax dispersion liquid 1 | Carbon dioxide | Acetone | 2.2 | 1.7 | 2.5 | 2.8 |
| Comparative Example 10 | Resin fine particle dispersion liquid 35 | Resin solution 7 | Colorant dispersion liquid 4 | Wax dispersion liquid 4 | Water | Aniline | 0.1 | 4.4 | 2.3 | 4.4 |

TABLE 12

| | | Granulation property | | | | Image stability (image density) | | Heat resistance |
|---|---|---|---|---|---|---|---|---|
| | | Particle size distribution (D4/D1) | D4 (μm) | D1 (μm) | Durability Development streak | Initial | After output on 18,000 sheets | Agglomeration property after heat cycle |
| Example 6 | Toner 1 | 1.05(A) | 5.90 | 5.62 | A | 1.52(A) | 1.46(A) | A |
| Example 7 | Toner 2 | 1.07(A) | 6.05 | 5.65 | A | 1.51(A) | 1.45(A) | A |

TABLE 12-continued

| | | Granulation property | | | | Image stability (image density) | | Heat resistance |
|---|---|---|---|---|---|---|---|---|
| | | Particle size distribution (D4/D1) | D4 (μm) | D1 (μm) | Durability Development streak | Initial | After output on 18,000 sheets | Agglomeration property after heat cycle |
| Example 8 | Toner 3 | 1.08(A) | 6.09 | 5.64 | A | 1.52(A) | 1.45(A) | B |
| Example 9 | Toner 4 | 1.09(A) | 6.19 | 5.68 | A | 1.50(A) | 1.44(A) | A |
| Example 10 | Toner 5 | 1.12(B) | 7.59 | 6.78 | C | 1.48(A) | 1.29(C) | B |
| Example 11 | Toner 6 | 1.15(B) | 7.85 | 6.83 | D | 1.43(A) | 1.26(C) | C |
| Example 12 | Toner 7 | 1.23(C) | 7.40 | 6.02 | A | 1.50(A) | 1.42(A) | A |
| Example 13 | Toner 8 | 1.05(A) | 5.91 | 5.63 | A | 1.50(A) | 1.44(A) | A |
| Example 14 | Toner 9 | 1.12(B) | 6.51 | 5.81 | D | 1.44(A) | 1.28(C) | C |
| Example 15 | Toner 10 | 1.24(C) | 7.54 | 6.08 | A | 1.50(A) | 1.43(A) | A |
| Example 16 | Toner 11 | 1.15(B) | 6.65 | 5.78 | A | 1.50(A) | 1.44(A) | A |
| Example 17 | Toner 12 | 1.08(A) | 6.09 | 5.64 | B | 1.47(A) | 1.35(B) | B |
| Example 18 | Toner 13 | 1.13(B) | 6.51 | 5.76 | D | 1.45(A) | 1.28(C) | B |
| Example 19 | Toner 14 | 1.22(C) | 7.31 | 5.99 | A | 1.50(A) | 1.42(A) | A |
| Example 20 | Toner 15 | 1.05(A) | 5.91 | 5.63 | A | 1.51(A) | 1.46(A) | A |
| Example 21 | Toner 16 | 1.07(A) | 6.06 | 5.66 | B | 1.49(A) | 1.39(B) | B |
| Example 22 | Toner 17 | 1.23(C) | 7.28 | 5.92 | A | 1.50(A) | 1.42(A) | A |
| Example 23 | Toner 18 | 1.06(A) | 5.97 | 5.63 | A | 1.51(A) | 1.46(A) | A |
| Example 24 | Toner 19 | 1.12(B) | 6.47 | 5.78 | C | 1.46(A) | 1.29(C) | B |
| Example 25 | Toner 20 | 1.16(B) | 6.75 | 5.82 | A | 1.50(A) | 1.44(A) | A |
| Example 26 | Toner 21 | 1.13(B) | 6.49 | 5.74 | C | 1.42(A) | 1.26(C) | B |
| Example 27 | Toner 22 | 1.12(B) | 6.46 | 5.77 | C | 1.42(A) | 1.27(C) | B |
| Example 28 | Toner 23 | 1.22(C) | 7.19 | 5.89 | C | 1.43(A) | 1.27(C) | B |
| Example 29 | Toner 24 | 1.21(C) | 7.10 | 5.87 | A | 1.50(A) | 1.43(A) | A |
| Example 30 | Toner 25 | 1.12(B) | 6.50 | 5.80 | C | 1.44(A) | 1.29(C) | B |
| Example 31 | Toner 26 | 1.08(A) | 6.11 | 5.66 | B | 1.49(A) | 1.39(B) | B |
| Example 32 | Toner 27 | 1.24(C) | 7.59 | 6.12 | B | 1.48(A) | 1.34(B) | B |
| Example 33 | Toner 28 | 1.24(C) | 7.58 | 6.11 | B | 1.48(A) | 1.36(B) | B |
| Comparative Example 3 | Comparative toner 1 | 1.24(C) | 7.61 | 6.14 | E | 1.41(A) | 1.14(E) | D |
| Comparative Example 4 | Comparative toner 2 | 1.23(C) | 7.48 | 6.08 | E | 1.41(A) | 1.15(E) | D |
| Comparative Example 5 | Comparative toner 3 | 1.21(C) | 7.24 | 5.98 | E | 1.43(A) | 1.18(E) | C |
| Comparative Example 6 | Comparative toner 4 | 1.22(C) | 7.33 | 6.01 | E | 1.42(A) | 1.17(E) | C |
| Comparative Example 7 | Comparative toner 5 | 1.31(E) | 8.23 | 6.28 | A | 1.50(A) | 1.42(A) | A |
| Comparative Example 8 | Comparative toner 6 | 1.35(E) | 8.52 | 6.31 | A | 1.50(A) | 1.41(A) | A |
| Comparative Example 9 | Comparative toner 7 | 1.23(C) | 7.49 | 6.09 | E | 1.41(A) | 1.13(E) | D |
| Comparative Example 10 | Comparative toner 8 | 1.24(C) | 7.63 | 6.15 | E | 1.42(A) | 1.16(E) | D |

[Evaluation Method]

<Granulation Property>

Granulation properties were evaluated by the particle size distributions (D4/D1) of the resin particles and the toners. It should be noted that evaluation criteria are as described below.

[Criteria of Evaluation for D4/D1]

A: less than 1.10

B: 1.10 or more and less than 1.20

C: 1.20 or more and less than 1.25

D: 1.25 or more and less than 1.30

E: 1.30 or more

<Durability>

An evaluation for durability was performed with a commercially available printer LBP9200C manufactured by Canon Inc. The LBP9200C adopts a one-component contact development system and regulates the amount of a toner on a developer carrier with a toner-regulating member. Used as an evaluation cartridge was a cartridge obtained by removing a toner in a commercially available cartridge, cleaning the inside of the cartridge through air blowing, and then loading 260 g of any one of the toners into the cartridge. The evaluation was performed by mounting the cartridge on a cyan station and mounting a dummy cartridge on any other station.

An image having a print percentage of 1% was continuously output under a low-temperature and low-humidity environment at 15° C. and 10% RH. Every time the image was output on 1,000 sheets, a solid image and a halftone image were output, and the presence or absence of the occurrence of a vertical streak resulting from the melt adhesion of the toner to the regulating member, i.e., the so-called development streak was visually observed. Finally, image output was performed on 20,000 sheets.

[Criteria of Evaluation]

A: no occurrence at 20,000 sheets

B: occurrence at more than 19,000 sheets and 20,000 sheets or less

C: occurrence at more than 18,000 sheets and 19,000 sheets or less

D: occurrence at more than 17,000 sheets and 18,000 sheets or less

E: occurrence at 17,000 sheets or less

<Image Stability>

The LBP9200C was used as a machine for evaluating an image density. An image after fixation was produced on color laser copy paper manufactured by Canon Inc. while a toner laid-on level was adjusted to 0.30 mg/cm$^2$ in terms of a solid image. Further, an image having a print percentage of 1% was output on 18,000 sheets under a normal-temperature and normal-humidity environment at 23° C. and 60% RH, and then the image was produced. The densities of the two images thus produced were measured with a reflection densitometer (500 Series Spectrodensitometer) manufactured by X-Rite Inc. The measurement was performed at five arbitrary points on each image, and the average of the densities at three points excluding the two extremes, i.e., the highest and lowest densities was evaluated.

[Criteria of Evaluation]

A: 1.40 or more

B: 1.30 or more and less than 1.40

C: 1.25 or more and less than 1.30

D: 1.20 or more and less than 1.25

E: less than 1.20

<Heat-Resistant Storage Stability after Heat Cycle Test>

Figure 2:
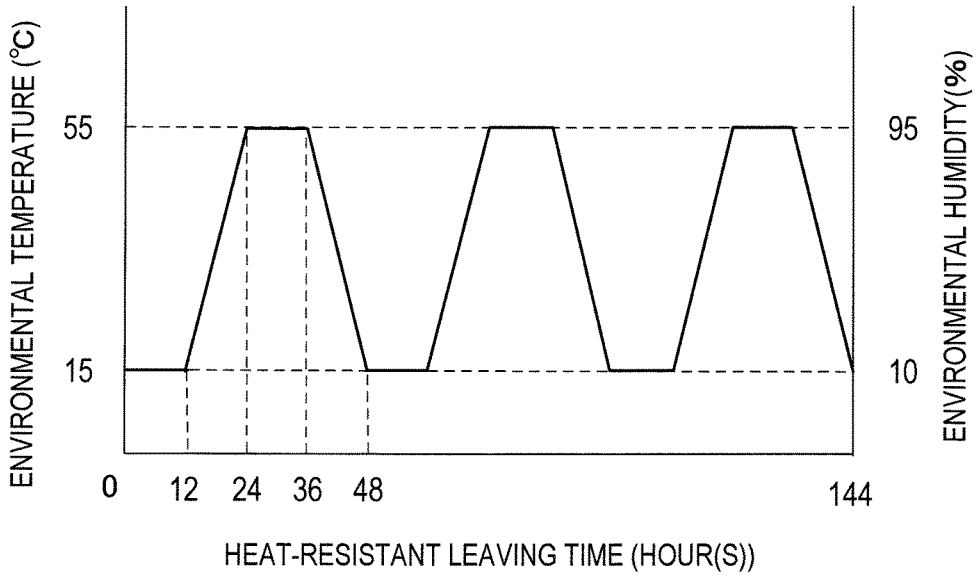
FIG. 2 is a time chart of a heat cycle in an evaluation for heat-resistant storage stability.

About 10 g of the toner 1 was loaded into a 100-ml polymer cup, and was left to stand under a low-temperature and low-humidity environment (at 15° C. and 10% RH) for 12 hours. After that, the environment was changed to a high-temperature and high-humidity environment (at 55° C. and 95% RH) over 12 hours. After the toner had been left to stand under the environment for 12 hours, the environment was changed to the low-temperature and low-humidity environment (at 15° C. and 10% RH) over 12 hours again. The foregoing cycle of operations was repeated three times, and then the toner was removed and its agglomeration was observed. A time chart of a heat cycle is shown in FIG. 2.

(Criteria of Evaluation for Heat-Resistant Storage Stability)

A: No agglomerate is observed and substantially the same state as that at an initial stage is maintained.

B: The toner tends to agglomerate to some extent, but the agglomerate is in a state of being collapsed by lightly shaking the polymer cup about five times and hence causes particularly no problems.

C: The toner tends to agglomerate but the agglomerate is in a state of being easily loosened with fingers.

D: Agglomeration vigorously occurs.

E: The toner solidifies.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-263977, filed Dec. 26, 2014, and Japanese Patent Application No. 2015-232615, filed Nov. 30, 2015, which are hereby incorporated by reference herein in their entirety.

What is claimed is:

1. A toner comprising a toner particle, the toner particle comprising a core-shell structure composed of a core particle and a shell phase on a surface of the core particle, the core particle comprising a resin X and a colorant;

the shell phase is derived from a resin fine particle comprising a resin Y, said resin Y having a crosslinked structure and an organic polysiloxane structure represented by formula (i)

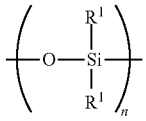

(i)

where $R^1$ represents an alkyl group, and n represents a polymerization degree and is an integer of 2 or more; and said resin Y being a polymer of a monomer composition comprising a polyester having a polymerizable unsaturated group, with an average number of polymerizable unsaturated groups in one molecule of the polyester being 1.4 to 2.6, wherein the resin fine particle swells in an organic solvent, the resin X, the resin Y, and the organic solvent satisfy formulae (1) and (2):

$$1.5 \leq |SP_X - SP_Y| \leq 3.1 \quad (1)$$

$$0 \leq |SP_{SOL} - (SP_X - SP_Y)/2| \leq 2.5 \quad (2)$$

where $SP_X$ represents a SP value ((J/cm$^3$)$^{1/2}$) of resin X, $SP_Y$ represents a SP value ((J/cm$^3$)$^{1/2}$) of resin Y, and $SP_{SOL}$ represents a SP value ((J/cm$^3$)$^{1/2}$) of the organic solvent, and the resin fine particle satisfies formulae (3) and (4):

$$80 \leq A \leq 140 \quad (3)$$

$$1.33 \leq (4\pi(B/2)^3/3)/(4\pi(A/2)^3/3) \leq 2.85 \quad (4)$$

where "A" represents a number-average particle diameter (nm) of the resin fine particle when the resin fine particle is dispersed in water, and "B" represents a number-average particle diameter (nm) of the resin fine particle when the resin fine particle is dispersed in the organic solvent.

2. A toner according to claim 1, wherein the shell phase is formed through a step of bringing the core particle and the resin fine particle into contact with each other in presence of the organic solvent.

3. A toner according to claim 1, wherein the resin X comprises a polyester as a main component and the resin Y comprises a polyester.

4. A toner according to claim 1, wherein the $SP_{SOL}$ satisfies formula (7):

$$18.2 \leq SP_{SOL} \leq 19.9 \quad (7).$$

5. A toner according to claim 1, wherein the $SP_Y$ is 24.0 (J/cm$^3$)$^{1/2}$ or less.

6. A toner according to claim 1, wherein the monomer composition further comprises a monomer having two or more polymerizable unsaturated groups, the monomer having a weight-average molecular weight of 200 to 2,000.

7. A toner according to claim 1, wherein the polymerizable unsaturated group of the polyester is derived from a dicarboxylic acid having a polymerizable unsaturated group and/or a diol having a polymerizable unsaturated group.

* * * * *